US012714181B2

(12) United States Patent
Bock et al.

(10) Patent No.: US 12,714,181 B2
(45) Date of Patent: Aug. 25, 2026

(54) ARTICLE OF FOOTWEAR HAVING A DISPLAY SYSTEM POWERED BY MOTION

(71) Applicant: PUMA SE, Herzogenaurach (DE)

(72) Inventors: Markus Bock, Herzogenaurach (DE); Reinhold Sussmann, Scheinfeld (DE)

(73) Assignee: PUMA SE, Herzogenaurach (DE)

( * ) Notice: Subject to any disclaimer, the term of this patent is extended or adjusted under 35 U.S.C. 154(b) by 279 days.

(21) Appl. No.: 18/383,340

(22) Filed: Oct. 24, 2023

(65) Prior Publication Data

US 2024/0130461 A1 Apr. 25, 2024
US 2024/0225171 A9 Jul. 11, 2024

Related U.S. Application Data

(60) Provisional application No. 63/418,847, filed on Oct. 24, 2022.

(51) Int. Cl.
*A43B 3/34* (2022.01)
*A43B 3/42* (2022.01)

(52) U.S. Cl.
CPC . *A43B 3/34* (2022.01); *A43B 3/42* (2022.01)

(58) Field of Classification Search
CPC ..... A43B 3/34; A43B 3/42
See application file for complete search history.

(56) References Cited

U.S. PATENT DOCUMENTS

| | | | | |
|---|---|---|---|---|
| 5,500,635 | A | 3/1996 | Mott | |
| 5,813,148 | A | 9/1998 | Guerra | |
| 8,464,442 | B1 | 6/2013 | Alford, II | |
| 2013/0033378 | A1 | 2/2013 | Donovan et al. | |
| 2014/0373395 | A1 | 12/2014 | White | |
| 2024/0008584 | A1* | 1/2024 | Donovan | A43B 3/24 |

OTHER PUBLICATIONS

107847004 A (Walker, S H et al.) machine translation (Year: 2018).*
International Search Report and Written Opinion, PCT/2023/060734, Apr. 8, 2024, 16 pages.

* cited by examiner

*Primary Examiner* — James A Dudek
(74) *Attorney, Agent, or Firm* — Quarles & Brady LLP

(57) ABSTRACT

A display system for an article of footwear includes a display device, a control module, and a power source. The display device includes an optoelectronic display. The control module is configured to communicate with the display device. The power source is embedded within a plate of the article of footwear. The plate includes carbon fiber and conductive filaments embedded within a substrate.

17 Claims, 14 Drawing Sheets

ARTICLE OF FOOTWEAR HAVING A DISPLAY SYSTEM POWERED BY MOTION

CROSS REFERENCE TO RELATED APPLICATIONS

This application claims the benefit of and priority to U.S. Provisional Application No. 63/418,847, filed on Oct. 24, 2022, which is incorporated by reference herein in its entirety.

BACKGROUND

1. Field of the Invention

The present disclosure relates generally to an article of footwear including a display system powered by motion.

2. Description of the Background

Many conventional shoes or other articles of footwear generally comprise an upper and a sole attached to a lower end of the upper. Conventional shoes further include an internal space, i.e., a void or cavity, which is created by interior surfaces of the upper and sole, that receives a foot of a user before securing the shoe to the foot. The sole is attached to a lower surface or boundary of the upper and is positioned between the upper and the ground. As a result, the sole typically provides stability and cushioning to the user when the shoe is being worn. In some instances, the sole may include multiple components, such as an outsole, a midsole, and a top portion. The outsole may provide traction to a bottom surface of the sole, and the midsole may be attached to an inner surface of the outsole and may provide cushioning or added stability to the sole. For example, a sole may include a particular foam material that may increase stability at one or more desired locations along the sole, or a foam material that may reduce stress or impact energy on the foot or leg when a user is running, walking, or engaged in another activity. The sole may also include additional components, such as plates, embedded with the sole to increase the overall stiffness of the sole and reduce energy loss during use.

The upper generally extends upward from the sole and defines an interior cavity that completely or partially encases a foot. In most cases, the upper extends over the instep and toe regions of the foot, and across medial and lateral sides thereof. Many articles of footwear may also include a tongue that extends across the instep region to bridge a gap between edges of medial and lateral sides of the upper, which define an opening into the cavity. The tongue may also be disposed below a lacing system and between medial and lateral sides of the upper, to allow for adjustment of shoe tightness. The tongue may further be manipulatable by a user to permit entry or exit of a foot from the internal space or cavity. In addition, the lacing system may allow a user to adjust certain dimensions of the upper or the sole, thereby allowing the upper to accommodate a wide variety of foot types having varying sizes and shapes.

The upper of many shoes may comprise a wide variety of materials, which may be utilized to form the upper and chosen for use based on one or more intended uses of the shoe. The upper may also include portions comprising varying materials specific to a particular area of the upper. For example, added stability may be desirable at a front of the upper or adjacent a heel region to provide a higher degree of resistance or rigidity. In contrast, other portions of a shoe may include a soft woven textile to provide an area with stretch-resistance, flexibility, air-permeability, or moisture-wicking properties.

However, in many cases, articles of footwear are provided with materials that create a consistent visual display that never varies during the use of the article of footwear. When the visual display of the article of footwear is varying, more attention is drawn to the article of footwear, and may create a more aesthetically pleasing appearance. Thus, there is a continuing desire for an article of footwear that can vary its visual appearance during the use of the article of footwear, and to further provide a way to power the variation in the visual appearance by motion.

SUMMARY

An article of footwear, as described herein, may have various configurations. The article of footwear may have an upper and a sole structure connected to the upper.

In some aspects, a display system for an article of footwear includes a display device, a control module, and a power source. The display device includes an optoelectronic display. The control module is configured to communicate with the display device. The power source is embedded within a plate of the article of footwear. The plate includes carbon fiber and conductive filaments embedded within a substrate.

In some aspects, the power source includes a piezoelectric transducer. In some aspects, the power source includes a storage cell that is electrically connected to the piezoelectric transducer. In some aspects, the storage cell is provided within a heel region of the plate. In some aspects, the power source is selectively electrically connected to the display device.

In some aspects, the optoelectronic display includes electrophoretic ink. In some aspects, the display device is located in a portion of an upper of the article of footwear. In some aspects, the display device includes panels that are configured to change color when a sufficient electrical charge is applied.

In some aspects, a method of using a display for an article of footwear includes a step of providing an optoelectronic display on an upper of the article of footwear, and a step of providing a circuit within a sole structure attached to the upper. The circuit includes a storage cell, a control module, and conductive leads. A plurality of piezoelectric transducers is embedded within a plate disposed in the sole structure. The method further includes a step of actuating the optoelectronic display to display a first color in a first portion of the upper, and a step of actuating the optoelectronic display to display a second color in a second portion of the upper. The second portion is different from the first portion, and the first color is different from the second color.

In some aspects, the optoelectronic display includes electrophoretic ink coated on or embedded within a panel formed by a plurality of fibers. In some aspects, the plurality of piezoelectric transducers comprises a first transducer, a second transducer, and a third transducer, wherein the second transducer is positioned between the first transducer and the third transducer. In some aspects, the first transducer is located in a forefoot region and disposed along a lateral side of a plate, and wherein the third transducer is located in the forefoot region and disposed along a medial side of the plate. In some aspects, the plate comprises carbon fiber. In some aspects, the storage cell includes a capacitor that is operatively connected to the plurality of piezoelectric transducers.

In some aspects, the control module is operatively connected to the plurality of piezoelectric transducers.

In other aspects, an article of footwear includes an energy harvesting device, an electrophoretic display, a power module, and a control module. The energy harvesting device is located in a portion of a sole structure. The electrophoretic display is located in a portion of an upper. The power module is in communication with the energy harvesting device and the electrophoretic display. The control module is configured to selectively direct an output from the energy harvesting device to the power module or the electrophoretic display based on an input signal.

In some aspects, the energy harvesting device includes a plurality of piezoelectric transducers disposed in two or more of a forefoot region, a midfoot region, or a heel region of the sole structure. In some aspects, the control module is configured to receive an input from a user device. In some aspects, the control module is configured for RFID or NFC communication with the user device. In some aspects, the energy harvesting device includes one or more piezoelectric transducers, an electromagnetism system, a solar cell, or a combination thereof.

Other aspects of the article of footwear, including features and advantages thereof, will become apparent to one of ordinary skill in the art upon examination of the figures and detailed description herein. Therefore, all such aspects of the article of footwear are intended to be included in the detailed description and this summary.

DETAILED DESCRIPTION OF THE DRAWINGS

Figure 1:
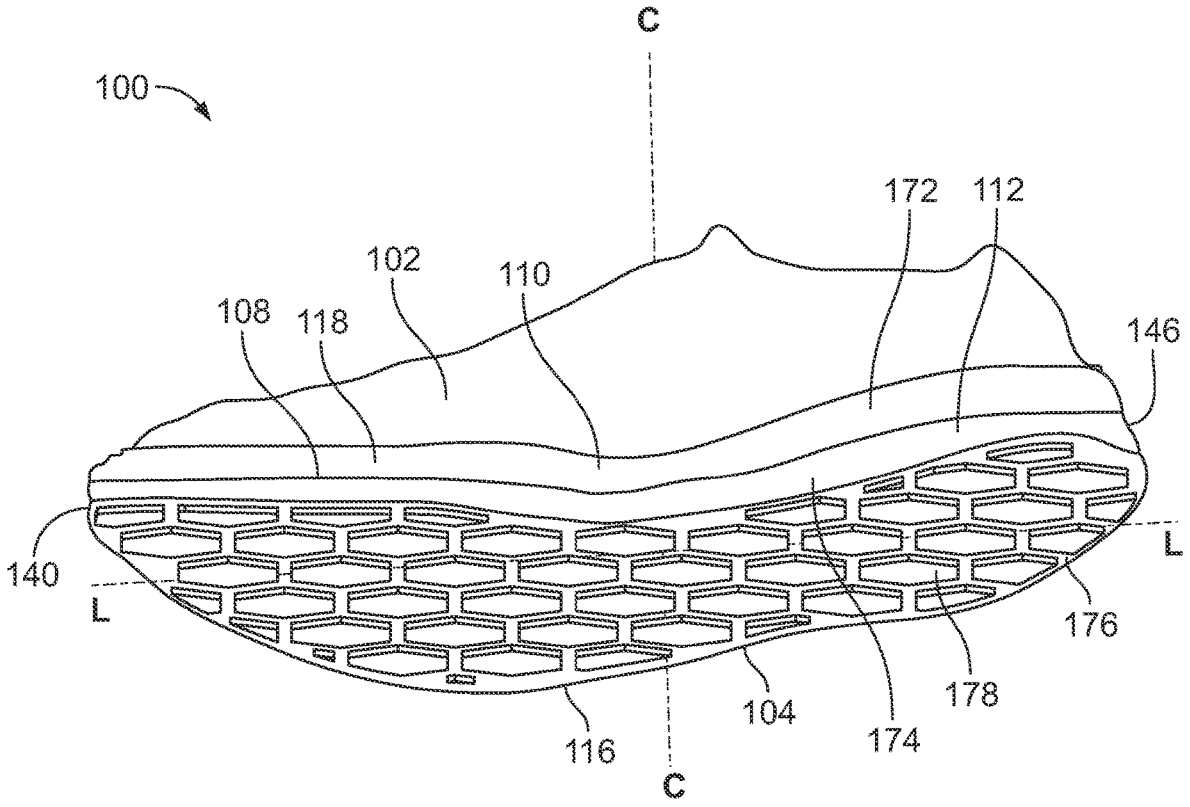
FIG. 1 is a perspective view of a bottom and medial side of an article of footwear configured as a right shoe that includes an upper and a sole structure, according to an embodiment of the disclosure.

The following discussion and accompanying figures disclose various embodiments or configurations of a shoe and a sole structure. Although embodiments of a shoe or sole structure are disclosed with reference to a sports shoe, such as a running shoe, tennis shoe, basketball shoe, etc., concepts associated with embodiments of the shoe or the sole structure may be applied to a wide range of footwear and footwear styles, including cross-training shoes, football shoes, golf shoes, hiking shoes, hiking boots, ski and snowboard boots, soccer shoes and cleats, walking shoes, and track cleats, for example. Concepts of the shoe or the sole structure may also be applied to articles of footwear that are considered non-athletic, including dress shoes, sandals, loafers, slippers, and heels. In addition to footwear, particular concepts described herein may also be applied and incorporated in other types of apparel or other athletic equipment, including helmets, padding or protective pads, shin guards, and gloves. Even further, particular concepts described herein may be incorporated in cushions, backpack straps, golf clubs, or other consumer or industrial products. Accordingly, concepts described herein may be utilized in a variety of products.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values ±5% of the numeric value that the term precedes.

The present disclosure is directed to an article of footwear and/or specific components of the article of footwear, such as an upper and/or a sole or sole structure. The upper may comprise a knitted component, a woven textile, and/or a non-woven textile. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, and/or other suitable knitting operations. The knit textile may have a plain knit structure, a mesh knit structure, and/or a rib knit structure, for example. Woven textiles include, but are not limited to, textiles formed by way of any of the numerous weave forms, such as plain weave, twill weave, satin weave, dobbin weave, jacquard weave, double weaves, and/or double cloth weaves, for example. Non-woven textiles include textiles made by air-laid and/or spun-laid methods, for example. The upper may comprise a variety of materials, such as a first yarn, a second yarn, and/or a third yarn, which may have varying properties or varying visual characteristics.

Figure 2:
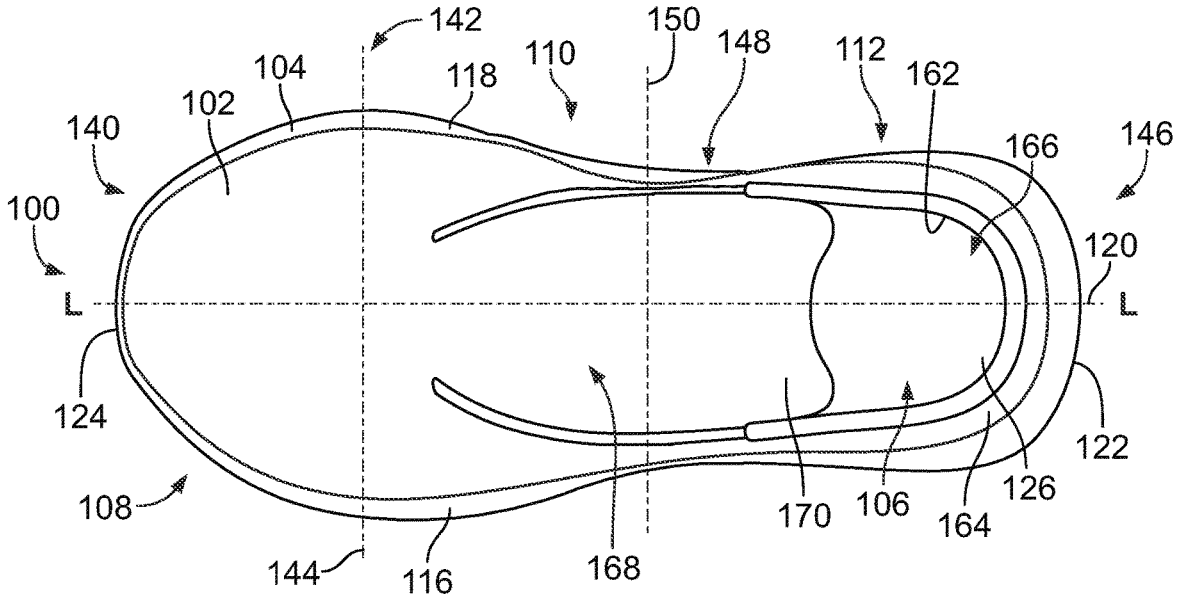
FIG. 2 is a top view of the article of footwear of FIG. 1 configured as a left shoe.
Figure 3:
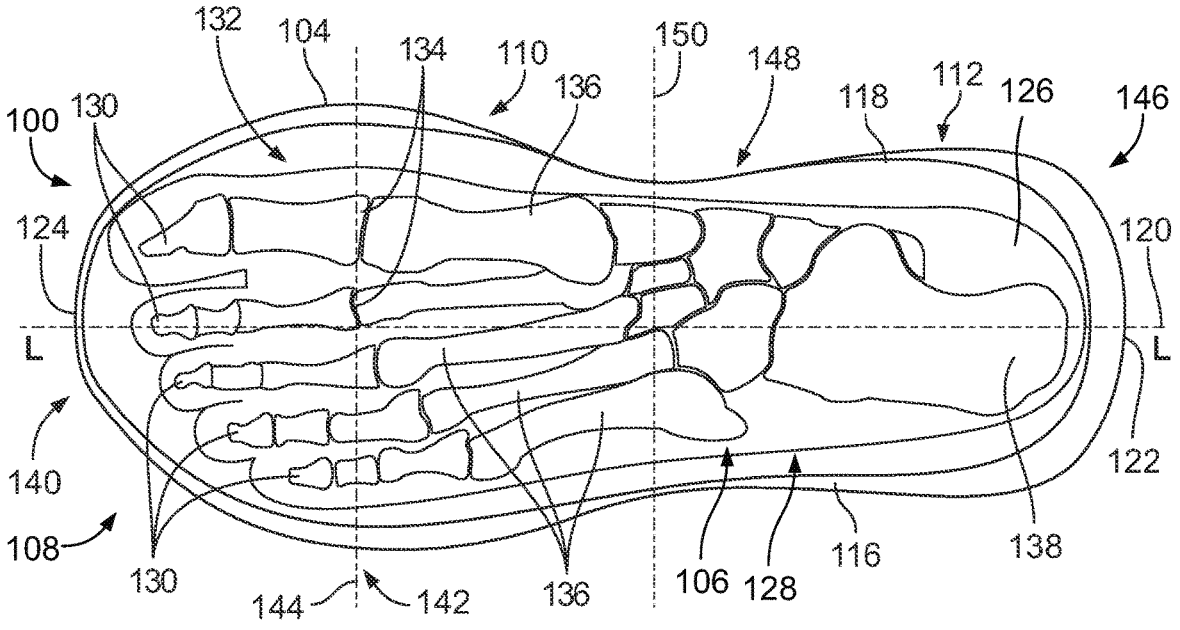
FIG. 3 is a top plan view of the article of footwear of FIG. 1 configured as a left shoe, with an upper removed and a user's skeletal foot structure overlaid thereon.

FIGS. 1-3 depict an exemplary embodiment of an article of footwear 100 including an upper 102 and a sole structure 104. The upper 102 is attached to the sole structure 104 and together define an interior cavity 106 (see FIGS. 2 and 3) into which a foot may be inserted. For reference, the article of footwear 100 defines a forefoot region 108, a midfoot region 110, and a heel region 112 (see FIGS. 2 and 3). The forefoot region 108 generally corresponds with portions of the article of footwear 100 that encase portions of the foot that includes the toes, the ball of the foot, and joints connecting the metatarsals with the toes or phalanges. The midfoot region 110 is proximate and adjoining the forefoot region 108, and generally corresponds with portions of the article of footwear 100 that encase the arch of the foot, along with the bridge of the foot. The heel region 112 is proximate and adjoining the midfoot region 110 and generally corresponds with portions of the article of footwear 100 that encase rear portions of the foot, including the heel or calcaneus bone, the ankle, and/or the Achilles tendon.

Many conventional footwear uppers are formed from multiple elements, e.g., textiles, polymer foam, polymer sheets, leather, and synthetic leather, which are joined through bonding or stitching at a seam. In some embodiments, the upper 102 of the article of footwear 100 is formed from a knitted structure or knitted components. In various embodiments, a knitted component may incorporate various types of yarn that may provide different properties to an upper. For example, one area of the upper 102 may be formed from a first type of yarn that imparts a first set of properties, and another area of the upper 102 may be formed from a second type of yarn that imparts a second set of properties. Using this configuration, properties of the upper 102 may vary throughout the upper 102 by selecting specific yarns for different areas of the upper 102.

With reference to the material(s) that comprise the upper 102, the specific properties that a particular type of yarn will impart to an area of a knitted component may at least partially depend upon the materials that form the various filaments and fibers of the yarn. For example, cotton may provide a soft effect, biodegradability, or a natural aesthetic to a knitted material. Elastane and stretch polyester may each provide a knitted component with a desired elasticity and recovery. Rayon may provide a high luster and moisture absorbent material, wool may provide a material with an increased moisture absorbance, nylon may be a durable material that is abrasion-resistant, and polyester may provide a hydrophobic, durable material.

Other aspects of a knitted component may also be varied to affect the properties of the knitted component and provide desired attributes. For example, a yarn forming a knitted component may include monofilament yarn or multifilament yarn, or the yarn may include filaments that are each formed of two or more different materials. In addition, a knitted component may be formed using a particular knitting process to impart an area of a knitted component with particular properties. Accordingly, both the materials forming the yarn and other aspects of the yarn may be selected to impart a variety of properties to particular areas of the upper 102.

In some embodiments, an elasticity of a knit structure may be measured based on comparing a width or length of the knit structure in a first, non-stretched state to a width or length of the knit structure in a second, stretched state after the knit structure has a force applied to the knit structure in a lateral direction. In further embodiments, the upper 102 may also include additional structural elements. For example, in some embodiments, a heel plate or cover (not shown) may be provided on the heel region 112 to provide added support to a heel of a user. In some instances, other elements, e.g., plastic material, logos, trademarks, etc., may also be applied and fixed to an exterior surface using glue or a thermoforming process. In some embodiments, the properties associated with the upper 102, e.g., a stitch type, a yarn type, or characteristics associated with different stitch types or yarn types, such as elasticity, aesthetic appearance, thickness, air permeability, or scuff-resistance, may be varied.

Referring again to FIG. 1, the sole structure 104 is connected or secured to the upper 102 and extends between a foot of a user and the ground when the article of footwear 100 is worn by the user. The sole structure 104 may include one or more components, which may include an outsole, a midsole, a heel, a vamp, and/or an insole. For example, in some embodiments, a sole structure may include an outsole that provides structural integrity to the sole structure, along with providing traction for a user, a midsole that provides a cushioning system, and an insole that provides support for an arch of a user. In addition, the insole may be a strobel board, a forefoot board, a lasting board, etc., or a combination thereof, and the insole may be provided between the upper 102 and the sole structure 104, or the insole may be provided as part of the upper 102.

Furthermore, the insole can be positioned within the interior cavity 106 of the upper 102, which can be in direct contact with a user's foot while an article of footwear 100 is being worn. Moreover, the upper 102 may also include a liner (not shown) that can increase comfort, for example, by reducing friction between the foot of the user and the upper 102, the sole 104, the insole, or the like, and/or by providing moisture wicking properties. The liner may line the entirety of the interior cavity 106 or only a portion thereof. In some embodiments, a binding (not shown) may surround an opening of the interior cavity 106 to secure the liner to the upper 102 and/or to provide an aesthetic element on the article of footwear 100.

Referring to FIGS. 2 and 3, the article of footwear 100 also defines a lateral side 116 and a medial side 118. When a user is wearing the shoes, the lateral side 116 corresponds with an outside-facing portion of the article of footwear 100 while the medial side 118 corresponds with an inside-facing portion of the article of footwear 100. As such, the article of footwear 100 has opposing lateral sides 116 and medial sides 118. The medial side 118 and the lateral side 116 adjoin one another along a longitudinal central plane or axis 120 of the article of footwear 100, which is coplanar with the longitudinal axis L of FIG. 1. As will be further discussed herein, the longitudinal central plane or axis 120 may demarcate a central, intermediate axis between the medial side 118 and the lateral side 116 of the article of footwear 100. Put differently, the longitudinal plane or axis 120 may extend between a rear, proximal end 122 of the article of footwear 100 and a front, distal end 124 of the article of footwear 100 and may continuously define a middle of an insole 126, the sole structure 104, and/or the upper 102 of the article of footwear 100, i.e., the longitudinal plane or axis 120 is a straight axis extending through the rear, proximal end 122 of the heel region 112 to the front, distal end 124 of the forefoot region 108.

Unless otherwise specified, and referring to FIGS. 2 and 3, the article of footwear 100 may be defined by the forefoot region 108, the midfoot region 110, and the heel region 112. The forefoot region 108 may generally correspond with portions of the article of footwear 100 that encase portions of a foot 128 that include the toes or phalanges 130, the ball of the foot 132, and one or more of the joints 134 that connect the metatarsals 136 of the foot 128 with the toes or phalanges 130. The midfoot region 110 is proximate and adjoins the forefoot region 108. The midfoot region 110 generally corresponds with portions of the article of footwear 100 that encase an arch of a foot 128, along with a bridge of the foot 128. The heel region 112 is proximate to the midfoot region 110 and adjoins the midfoot region 110. The heel region 112 generally corresponds with portions of the article of footwear 100 that encase rear portions of the foot 128, including the heel or calcaneus bone 138, the ankle (not shown), and/or the Achilles tendon (not shown).

Still referring to FIGS. 2 and 3, the forefoot region 108, the midfoot region 110, the heel region 112, the medial side 118, and the lateral side 116 are intended to define boundaries or areas of the article of footwear 100. To that end, the forefoot region 108, the midfoot region 110, the heel region 112, the medial side 118, and the lateral side 116 generally characterize sections of the article of footwear 100. Certain aspects of the disclosure may refer to portions or elements that are coextensive with one or more of the forefoot region 108, the midfoot region 110, the heel region 112, the medial side 118, and/or the lateral side 116. Further, both the upper 102 and the sole structure 104 may be characterized as having portions within the forefoot region 108, the midfoot region 110, the heel region 112, and/or along the medial side 118 and/or the lateral side 116. Therefore, the upper 102 and the sole structure 104, and/or individual portions of the upper 102 and the sole structure 104, may include portions thereof that are disposed within the forefoot region 108, the midfoot region 110, the heel region 112, and/or along the medial side 118 and/or the lateral side 116.

Still referring to FIGS. 2 and 3, the forefoot region 108, the midfoot region 110, the heel region 112, the medial side 118, and the lateral side 116 are shown in detail. The forefoot region 108 extends from a toe end 140 to a widest portion 142 of the article of footwear 100. The widest portion 142 is defined or measured along a first line 144 that is perpendicular with respect to the longitudinal axis 120 that extends from a distal portion of the toe end 140 to a distal portion of a heel end 146, which is opposite the toe end 140. The midfoot region 110 extends from the widest portion 142 to a thinnest portion 148 of the article of footwear 100. The thinnest portion 148 of the article of footwear 100 is defined as the thinnest portion of the article of footwear 100 measured across a second line 150 that is perpendicular with respect to the longitudinal axis 120. The heel region 112 extends from the thinnest portion 148 to the heel end 146 of the article of footwear 100.

It should be understood that numerous modifications may be apparent to those skilled in the art in view of the foregoing description, and individual components thereof may be incorporated into numerous articles of footwear. Accordingly, aspects of the article of footwear 100 and components thereof, may be described with reference to general areas or portions of the article of footwear 100, with an understanding the boundaries of the forefoot region 108, the midfoot region 110, the heel region 112, the medial side 118, and/or the lateral side 116 as described herein may vary between articles of footwear. However, aspects of the article of footwear 100 and individual components thereof, may also be described with reference to exact areas or portions of the article of footwear 100 and the scope of the appended claims herein may incorporate the limitations associated with these boundaries of the forefoot region 108, the midfoot region 110, the heel region 112, the medial side 118, and/or the lateral side 116 discussed herein.

Still referring to FIGS. 2 and 3, the medial side 118 begins at the distal, toe end 140 and bows outward along an inner side of the article of footwear 100 along the forefoot region 108 toward the midfoot region 110. The medial side 118 reaches the first line 144, at which point the medial side 118 bows inward, toward the central, longitudinal axis 120. The medial side 118 extends from the first line 144, i.e., the widest portion 142, toward the second line 150, i.e., the thinnest portion 148, at which point the medial side 118 enters into the midfoot region 110, i.e., upon crossing the first line 144. Once reaching the second line 150, the medial side 118 bows outward, away from the longitudinal, central axis 120, at which point the medial side 118 extends into the heel region 112, i.e., upon crossing the second line 150. The medial side 118 then bows outward and then inward toward the heel end 146 and terminates at a point where the medial side 118 meets the longitudinal, central axis 120.

The lateral side 116 also begins at the distal, toe end 140 and bows outward along an outer side of the article of footwear 100 along the forefoot region 108 toward the midfoot region 110. The lateral side 116 reaches the first line 144, at which point the lateral side 116 bows inward, toward the longitudinal, central axis 120. The lateral side 116 extends from the first line 144, i.e., the widest portion 142, toward the second line 150, i.e., the thinnest portion 148, at which point the lateral side 116 enters into the midfoot region 110, i.e., upon crossing the first line 144. Once reaching the second line 150, the lateral side 116 bows outward, away from the longitudinal, central axis 120, at which point the lateral side 116 extends into the heel region 112, i.e., upon crossing the second line 150. The lateral side 116 then bows outward and then inward toward the heel end 146 and terminates at a point where the lateral side 116 meets the longitudinal, central axis 120.

Still referring to FIGS. 2 and 3, the upper 102 extends along the lateral side 116 and the medial side 118, and across the forefoot region 108, the midfoot region 110, and the heel region 112 to house and enclose a foot of a user. When fully assembled, the upper 102 also includes an interior surface 162 and an exterior surface 164. The interior surface 162 faces inward and generally defines the interior cavity 106, and the exterior surface 164 of the upper 102 faces outward and generally defines an outer perimeter or boundary of the upper 102. The upper 102 also includes an opening 166 that is at least partially located in the heel region 112 of the article of footwear 100, which provides access to the interior cavity 106 and through which a foot may be inserted and removed. In some embodiments, the upper 102 may also include an instep region 168 that extends from the opening 166 in the heel region 112 over an area corresponding to an instep of a foot to an area proximate the forefoot region 108. The instep region 168 may comprise an area similar to where a tongue 170 of the present embodiment is disposed. In some embodiments, the upper 102 does not include the tongue 170, i.e., the upper 102 is tongueless.

In the illustrated embodiment, the sole structure 104 includes a midsole 172 and an outsole 174. The outsole 174 may define a bottom end or bottom surface 176 of the sole structure 104 across the heel region 112, the midfoot region 110, and the forefoot region 108. Further, the outsole 174 may be a ground-engaging portion or include a ground-engaging surface of the sole structure 104 and may be opposite of the insole thereof. As illustrated in FIG. 1, the bottom surface 176 of the outsole 174 may include a tread pattern 178 that can include a variety of shapes and configurations. The outsole 174 may be formed from one or more materials to impart durability, wear-resistance, abrasion resistance, or traction to the sole structure 104. In some embodiments, the outsole 174 may be formed from any kind of elastomer material, e.g., rubber, including thermoset elastomers or thermoplastic elastomers, or a thermoplastic material, e.g., thermoplastic polyurethane (TPU). In some embodiments, the outsole 174 may define a shore A hardness up to 95. In addition, the outsole 174 may be manufactured by a process involving injection molding, vulcanization, printing layer by layer, i.e., additive manufacturing systems or methods, and the like.

Still referring to FIG. 1, the midsole 172 may be individually constructed from a thermoplastic material, such as polyurethane (PU), for example, and/or an ethylene-vinyl acetate (EVA), copolymers thereof, or a similar type of material. In other embodiments, the midsole 172 may be an EVA-Solid-Sponge ("ESS") material, an EVA foam (e.g., PUMA® ProFoam Lite™, IGNITE Foam), polyurethane, polyether, an olefin block copolymer, organosheets, a thermoplastic material (e.g., a thermoplastic polyurethane, a thermoplastic elastomer, a thermoplastic polyolefin, etc.), or a supercritical foam. The midsole 172 may be a single polymeric material or may be a blend of materials, such as an EVA copolymer, a thermoplastic polyurethane, a polyether block amide (PEBA) copolymer, and/or an olefin block copolymer. One example of a PEBA material is PEBAX®. In some embodiments, the midsole 172 is manufactured by a process involving injection molding, vulcanization, printing layer by layer, i.e., additive manufacturing systems or methods, and the like.

In embodiments where the midsole 172 is formed from a supercritical foaming process, the supercritical foam may comprise micropore foams or particle foams, such as a TPU, EVA, PEBAX®, or mixtures thereof, manufactured using a process that is performed within an autoclave, an injection molding apparatus, or any sufficiently heated/pressurized container that can process the mixing of a supercritical fluid (e.g., $CO_2$, $N_2$, or mixtures thereof) with a material (e.g., TPU, EVA, polyolefin elastomer, or mixtures thereof) that is preferably molten. During an exemplary process, a solution of supercritical fluid and molten material is pumped into a pressurized container, after which the pressure within the container is released, such that the molecules of the supercritical fluid rapidly convert to gas to form small pockets within the material and cause the material to expand into a foam. In further embodiments, the midsole 172 may be formed using alternative methods known in the art, including the use of an expansion press, an injection machine, a pellet expansion process, a cold foaming process, a compression molding technique, die cutting, or any combination thereof. For example, the midsole 172 may be formed using a process that involves an initial foaming step in which supercritical gas is used to foam a material and then compression molded or die cut to a particular shape.

Examples of visual display technologies may be optoelectronic displays that include, but are not limited to: electrochemical transistor based visual display technologies, LCD panel technologies, LED screen technologies, fiber optic technologies, electrochromographic materials (including photonic lattices or crystals), electronic paper technologies (including electrophoretic ink technologies, electrowetting technologies and electrofluidic technologies), electroluminescent strips, as well as other visual display technologies. In some embodiments, visual display portions can be associated with electronic paper technologies using electrophoretic ink. Several examples are disclosed in U.S. Pat. Nos. 7,535,624; 7,528,822; 7,420,549; 7,167,155; 7,201,952; 6,987,603; 6,922,276; 6,864,875, each of which is hereby incorporated by reference in their entirety.

In some embodiments, visual display portions can be associated with flexible electronic paper technologies using electrophoretic ink which retain a visual display after removal of applied power. Such technologies advantageously reduce the power requirements of the display system, only requiring power to change the visual display. Examples are disclosed in any of the following: U.S. Pat. Nos. 8,502,788, 7,944,597, 7,675,672, 7,195,170, 6,936,190, and 6,639,578, the entirety of each being hereby incorporated by reference. In some embodiments, visual display portions can be associated with electronically controllable visually dynamic textiles or flexible substrates as are disclosed in U.S. Patent Publication Number 2003/0224155, the entirety of which is hereby incorporated by reference.

Figure 4:
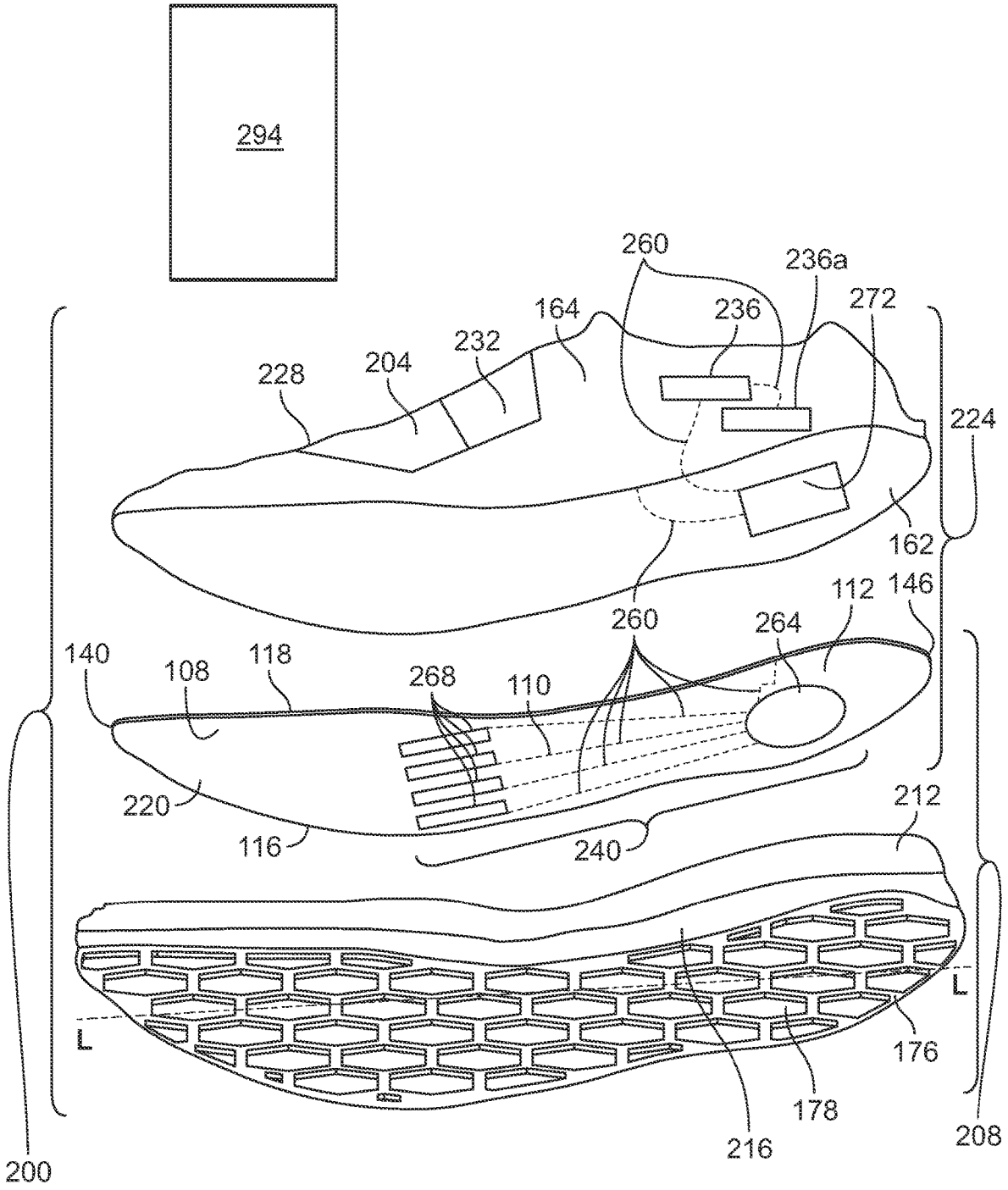
FIG. 4 is schematic representation of an exploded view of a medial side of an article of footwear with a display system powered by motion, configured as a right shoe, according to another embodiment of the disclosure.

In the illustrated embodiment of FIG. 4, an article of footwear 200 includes an upper 204 that is attached to a sole structure 208 having a midsole 212 and an outsole 216. In some embodiments, the sole structure 208 includes a plate 220, which is an elongated layer composed of a relatively stiff or rigid material. A first display system 224 includes a display device 228 that includes one or more panels 232 that are attached to the upper 204, one or more control modules 236 and/or 236*a*, and a power source 240. In some embodiments, the panels 232 each form an optoelectronic or electrophoretic display. That is, the panel 232 includes a substrate that has a material sandwiched between two electrodes, as disclosed in the patents noted above and incorporated by reference herein. When subjected to a sufficient electrical charge, the panel 232 changes color. The sufficient electrical charge can be measured by an increase in electrical current or voltage that can trigger the change in color depending upon the applied polarity, i.e., positive and negative, across the electrodes. In some embodiments, the panel 232 is configured to switch between a first bi-stable color and a second bi-stable color. For example, when the panel 232 is subjected to a sufficient electrical charge of a certain polarity, the color of the panel 232 can change from yellow to blue, and when the panel 232 is subjected to another sufficient electrical charge of a different polarity, the color of the panel 232 can change from blue back to yellow. In some embodiments, the panels 232 are positioned in the forefoot region 108, in the midfoot region 110, or the heel region 112 of the upper 204. In this way, the panels 232 of the display device 228 can display a variety of different images, pictures, and coloration of the upper 204 as the color of each of the panels 232 are changed. For example, each panel can act as a pixel in an image to create a desired image or pattern.

Figure 5A:
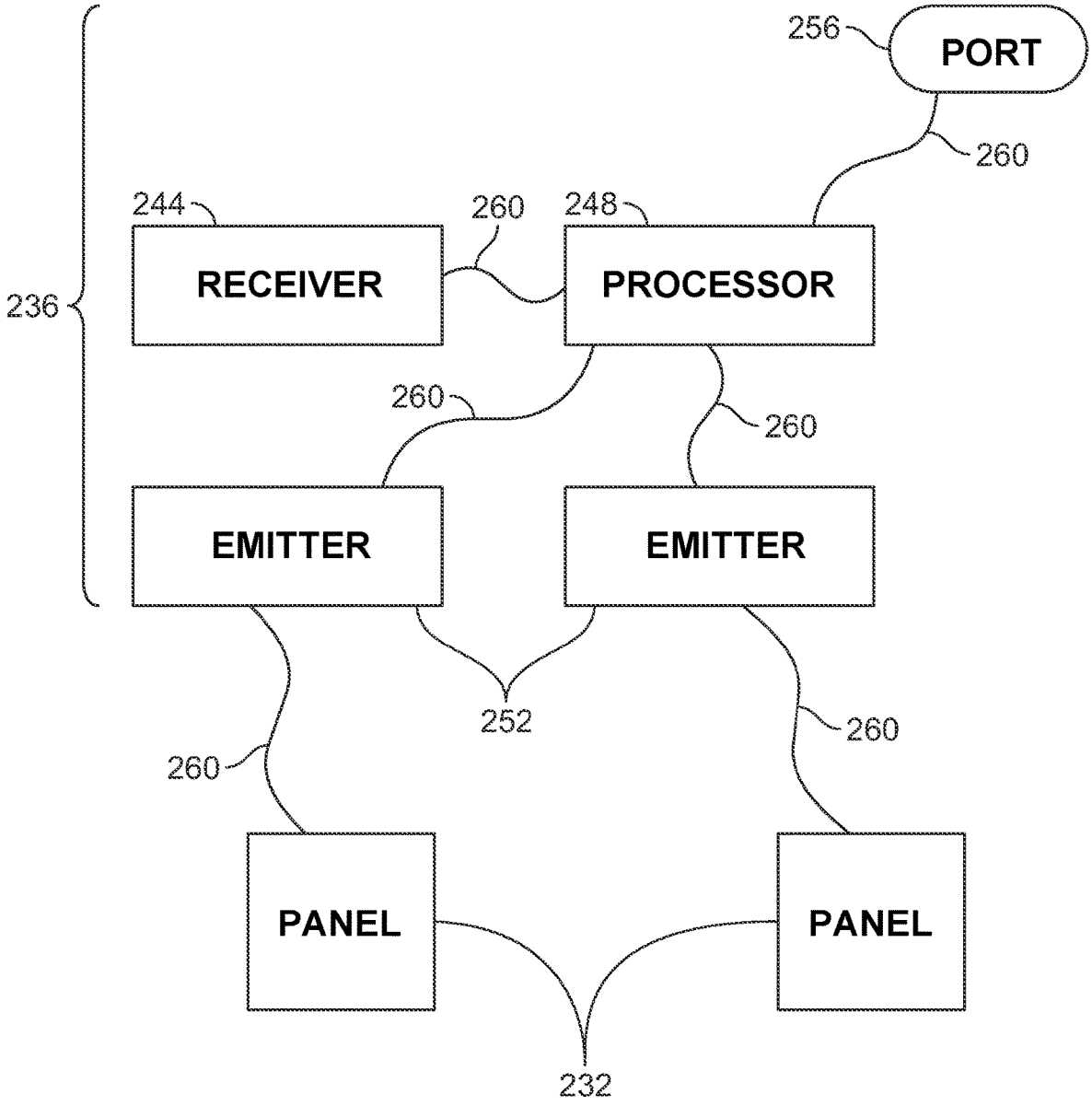
FIG. 5A is a schematic representation of a control module suitable for use in the article of footwear of FIG. 4.

Referring to FIG. 5A, the control module 236 includes a receiver 244, a processor 248 and an emitter 252. The receiver 244 is configured to receive input in the form of data, signals, information, or commands that are transmitted wirelessly to the receiver 244, and the receiver 244 is configured to deliver the input to the processor 248. In some embodiments, the receiver 244 is configured to receive input via a port 256, and the receiver 244 is configured to deliver the input to the processor 248. In some embodiments, the processor 248 is configured to apply an algorithm or program to the received input to produce an output in the form of electrical signals delivered to the emitters 252. The emitters 252 are configured to either produce or amplify the electrical signal from the processor 248 and send the electrical signal to the various panels 232 through conductive leads 260. In some embodiments, the electrical signals have sufficient electrical charge to trigger the various panels 232 to switch colors as the control module 236 dictates. In this way, the control module 236 can selectively communicate with the display device 228.

As illustrated in FIG. 4, the power source 240 provides the electrical power that is utilized by the control module 236 and the panels 232 of the display device 228. In some embodiments, the power source 240 includes one or more storage cells 264 that are configured to store electrical power. For example, the storage cell 264 may include one or more capacitors, supercapacitors, batteries, or a combination thereof. The one or more storage cells can form a power module that can be in communication with an energy harvesting device and/or the display device.

In some embodiments, the storage cell 264 is electrically connected to one or more energy harvesting devices by one or more conductive leads 260. For example, the energy harvesting devices may include piezoelectric transducers 268. In some implementations, the energy harvesting devices may include piezoelectric transducers, an electromagnetism system, solar cells, other energy harvesting systems, or a combination thereof.

Each of the piezoelectric transducers 268 are configured to generate or produce electrical power as the piezoelectric transducer 268 is deformed when subjected to a mechanical force, such as, e.g., bending, compression, and tension in one or more directions, and the generated power is delivered to the storage cell 264 by one of the conductive leads 260. The piezoelectric transducers 268 are configured so that as a wearer of the article of footwear 200 takes a footstep, the piezoelectric transducer 268 is subjected to the mechanical force that causes deformation of the piezoelectric transducer 268 and, consequently, conversion of the mechanical force to electrical energy delivered as an output via the conductive leads 260 to at least one of the storage cell 264, the control module 236, or the display device 228, or combinations thereof. In this way, the display device 228 can be powered by the motion of the article of footwear 200.

The magnitude of output electrical energy generated by the piezoelectric transducers 268 can be determined by arranging the piezoelectric transducers 268 along the plate 220 in particular sizes and quantities. For example, greater numbers of piezoelectric transducers 268 may be capable of generating greater magnitudes of output electrical energy. In a similar fashion, locating the piezoelectric transducers 268 in particular regions or areas along the plate 220 that are subjected to greater or maximum deformation, such as, e.g., along the midfoot region 110 or the forefoot region 108 where greater amounts of bending occur during use as compared to along the heel region 112, the magnitude of output electrical energy produced by the piezoelectric transducers 268 can be controlled. It will also be appreciated that the magnitude of output electrical energy is influenced by the orientation of the piezoelectric transducers 268, where an axial and/or longitudinal orientation along the longitudinal axis L yields greater amounts of deformation when subjected to bending, while a vertical orientation in a direction perpendicular to the longitudinal axis L yields greater amounts of deformation when subjected to compression and/or tension along that same vertical direction. It will also be appreciated that one or more of the piezoelectric transducers 268 may be in direct communication with the control module 236 as an input signal for various control purposes, such as, e.g., gathering data, changing display colors, or switching among operative modes or configurations, or the like. For example, one or more of the piezoelectric transducers 268 may be arranged to communicate with the control module 236 for answering a telephone call, or pausing music, or actuating a closure mechanism, among other selective configurations. It is further envisioned that such configurations may correspond to particular symbols, icons, graphics, colors, or combinations thereof that are displayed on the display device 228 as a result of the operative connection among, at least, the piezoelectric transducers 268, the control module 236, the storage cell 264, and the display device 228.

In some embodiments, the plate 220 is formed by additive manufacturing methods, such as, e.g., printing layer-by-layer. In some embodiments, the plate 220 includes carbon fiber and a conductive filament that are embedded within a substrate. The plate 220 can include a plurality of carbon fibers and a plurality of conductive filaments embedded within the substrate, or in composite layers of the plate, or along an upper surface or a lower surface of the plate 220. The plate 220 is more rigid than the midsole 212 or the outsole 216. Preferably, the plate 220 extends from the forefoot region 108 to the heel region 112, although other configurations are possible. In some embodiments, the plate 220 is adjacent to the midsole 212 and the upper 204. In some embodiments, the plate 220 is embedded in the midsole 212 (see FIG. 4). A portion of the control module 236 can be positioned on the interior surface 162 (see FIG. 2), the exterior surface 164 (see FIG. 11) of the upper 204 (see FIG. 4) or embedded within the upper 204. A portion of the control module 236 may be positioned adjacent to the midsole 212 or embedded in the midsole 212 (see FIG. 4). In some embodiments, a portion of the control module 236 is adjacent to or embedded in the plate 220 (not shown). In some embodiments a portion of the power source 240 is positioned on the interior surface 162, the exterior surface 164 of the upper 204, or embedded within the upper 204 (not shown). In some embodiments a portion of the power source 240 is adjacent to the midsole 212 or embedded in the midsole 212 (not shown). In some embodiments a portion of the power source 240 is adjacent to or embedded in the plate 220 (see FIG. 4).

Still referring to FIG. 4, in some embodiments the piezoelectric transducers 268 are positioned in the forefoot region 108 the midfoot region 110, or the heel region 112. In the illustrated embodiment, the storage cell 264 is positioned in the heel region 112, although in other embodiments the storage cell 264 may be disposed within forefoot region 108 or the midfoot region 110. In some embodiments, the storage cell 264 is connected to the control module 236 and the panels 232 via one or more conductive leads 260 and an electrical contact 272. In some embodiments, the electrical contact 272 is positioned adjacent to or embedded in the plate 220, adjacent to or embedded in the upper 204 (see FIG. 4), or adjacent to or embedded in the midsole 212. The emitters 252 control the electrical contact 272 to selectively electrically connect the storage cell 264 to the panels 232 of the display device 228. In some embodiments, when the control module 236 includes the port 256 (see FIG. 5A), electrical power can be delivered to the storage cell 264 via conductive leads 260.

Figure 5B:
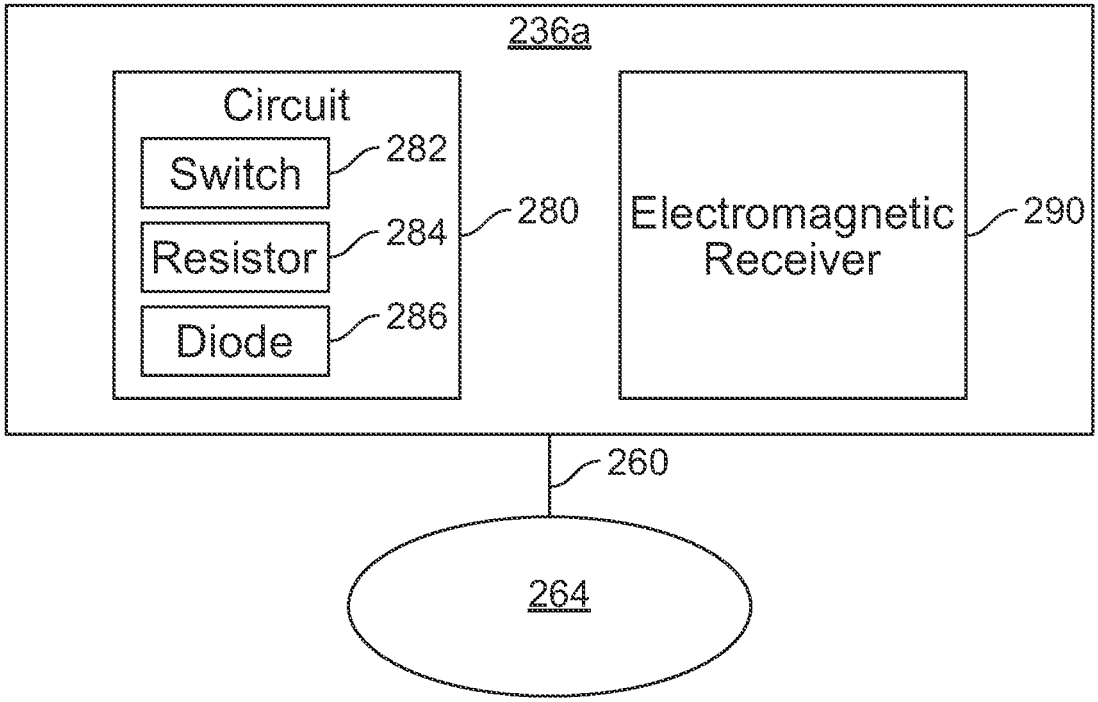
FIG. 5B is a schematic representation of another example control module for use in the article of footwear of FIG. 4.

In an embodiment illustrated in the schematic of FIG. 5B, the control module **236*a* includes a circuit 280 that is electrically coupled to the storage cell 264 by conductive leads 260. In this way, a circuit may be formed that includes the storage cell 264 and the control module 236*a*. The circuit 280 may be used to selectively electrically connect the storage cell 264 to the panels 232 of the display device 228. In this way, the storage cell 264 (e.g., capacitor) can maintain a charge while the article of footwear 200 is not in use. The circuit 280 may include a switch, such as a mechanical selector switch or a pressure switch, that selectively closes the circuit, allowing the storage cell 264 to discharge and power the panels 232. When the switch is not engaged, the circuit can be opened to maintain the charge of the storage cell 264. For example, the switch 282 can be a mechanical switch that is pushed into an engaged position when the user places a foot into the article of footwear 200. The switch may be located within the forefoot region 108, within the midfoot region 110, or within the heel region 112. The switch 282 may include a spring that biases the switch 282 in an open position when the force is removed. The circuit 280 may also include one or more resistors 284 that can be used to control the charge and discharge rate of the storage cell 264. The circuit 280 may also optionally include diodes 286** to select a direction of current flow.

Figure 5C:
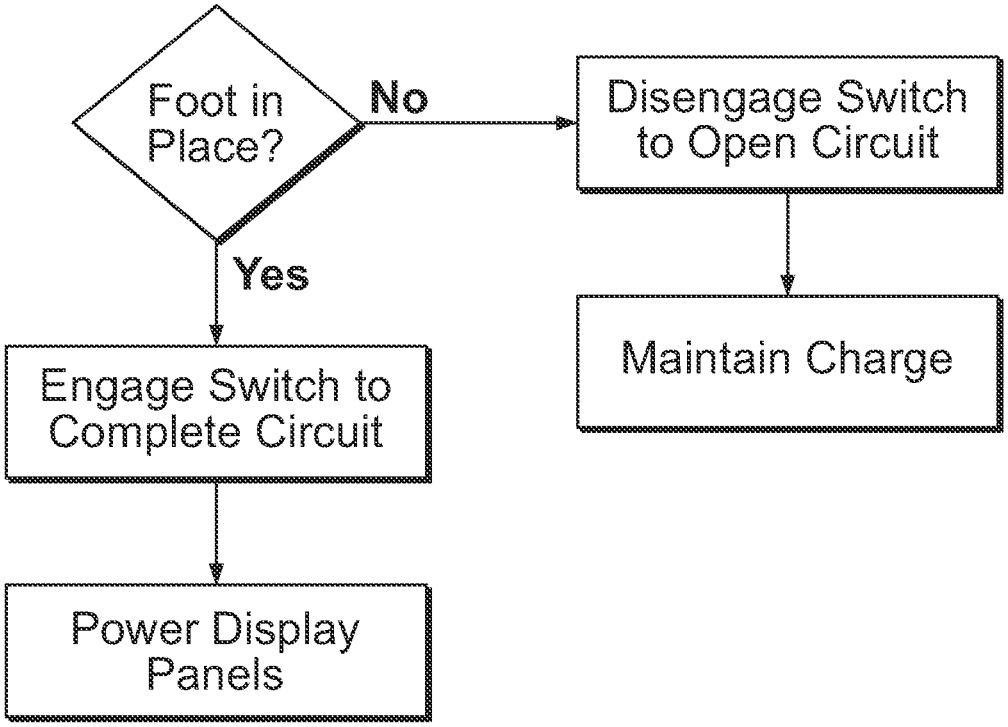
FIG. 5C is a flowchart representation of an example method of operating the display system of FIG. 4.

In some embodiments, the switch may be configured to engage (i.e., close the circuit) when a foot is secured into the article of footwear 200. In this way, the storage cell 264 may be charged and the panels 232 may be powered whenever a user is wearing the article of footwear 200. For example, FIG. 5C provides a flow chart that illustrates an example process for selectively powering panels 232. In other embodiments, the switch may be configured to engage when a foot is placed in the article of footwear 200 and planted on a surface (e.g., ground). In this way, the storage cell 264 can be discharged to power the panels 232 when the foot is planted.

In some embodiments, the control module 236*a* may include an electromagnetic receiver 290, such as a conductive coil. For example, the electromagnetic receiver 290 may be configured to receive power and near field communication (NFC) from a user device 294 (see FIG. 4), such as, e.g., a smartphone or another suitable device capable of wirelessly communicating with the control module 236*a*. For example, a nearby smartphone can be configured to generate a magnetic field that induces a current in the electromagnetic receiver 290. Such a current may be used to temporarily power the panels 232 to change the display. The smartphone may additionally provide a radiofrequency signal that may be interpreted by the control module 236 for communication therewith. In some embodiments, the smartphone, such as the user device 294 in FIG. 4, runs a program or application, e.g., a mobile application, a web applet, or the like, which provides a user interface through which the user can interact with the article of footwear 200. In this way, the user can use their smartphone or other device to select a color, pattern, etc. for display.

Figure 6:
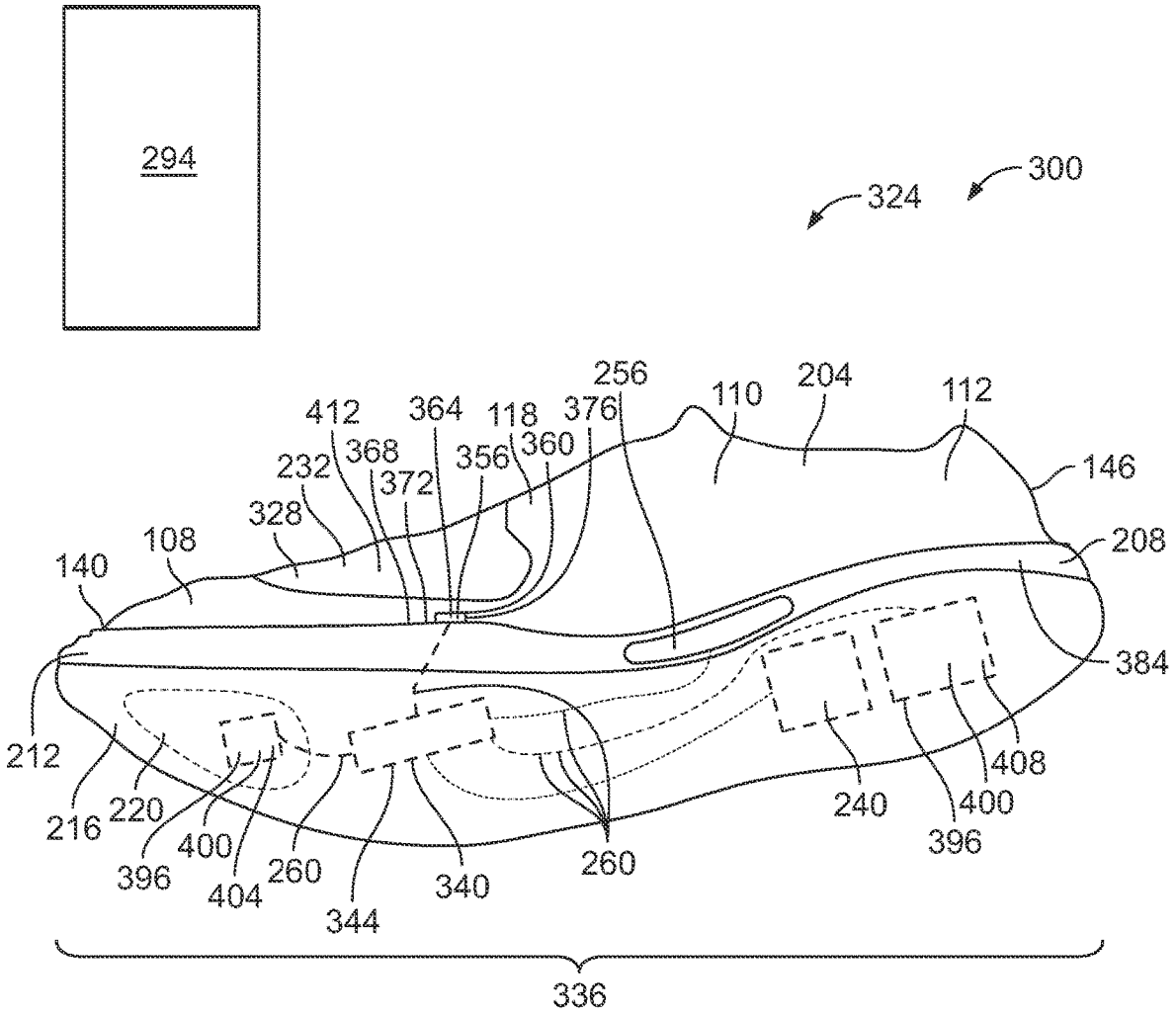
FIG. 6 is a schematic representation of a perspective view of a medial side of an article of footwear with a display system configured as a right shoe, according to another embodiment of the disclosure.

FIG. 6 depicts another embodiment of an article of footwear 300. In this embodiment, elements that are shared with—i.e., that are structurally and/or functionally identical or similar to—elements present in the article of footwear 100 and the article of footwear 200 are represented by like reference numerals. Article of footwear 300 includes the upper 204 attached to the sole structure 208 having the midsole 212 and the outsole 216. In some embodiments, the sole structure 208 includes the plate 220. The article of footwear 300 further includes a second display system 324 that has an optoelectronic display device 328 including the panel 232 provided on the upper 204, and a control system 336 having a first circuit 340 attached to the sole structure 208. The first circuit 340 comprises a control module 344 and the power source 240 that are configured to communicate with the panel 232 via conductive leads 260. In some embodiments, the first circuit 340 is disposed on or retained within the sole structure 208, or both. In some embodiments, the first circuit 340 is disposed on or retained within the midsole 212, or both. In some embodiments, the first circuit 340 is retained by the midsole 212. For example, the power source 240 may be embedded within or disposed between layers of the sole structure 208 such as the midsole 212 and the outsole 216. The control module 344 may be embedded within or disposed between layers of the sole structure 208 such as the midsole 212 and the insole 126 (not shown).

The conductive leads 260 may extend along the sole structure 208, between and through the layers of the sole structure 208 such as the midsole 212, and into contact with or along the upper 204. The conductive leads 260 are electrically connected to at least one connector 356. The at least one connector 356 includes a forward connector 360. In some embodiments, the at least one connector 356 has at least one thin film transistor or TFT 364 that is positioned between the upper 204 and the midsole 212 along a periphery 368 of the upper 204, e.g., an edge or boundary where the upper 204 and the sole structure 208, such as the midsole 212, are joined together. In some embodiments, the entire periphery 368 functions as the at least one connector 356. In some embodiments, the at least one connector 356 is provided in the form of at least one segment 372 of the periphery 368, and the at least one segment 372 can include a first segment 376. In some embodiments, the at least one connector 356 is attached between the upper 204 and the sole structure 208, separately and spaced apart from the periphery 368.

Still referring to FIG. 6, the control system 336 includes one or more ports 256 and the power source 240 may be rechargeable via the port 256. To that end, the port 256 is in electrical communication with the power source 240, the control module 344, or both, by conductive leads 260. In some embodiments, the at least one port 256 includes an electromagnetic receiver, such as a conductive coil. In some embodiments, the at least one port 256 is configured to interface or electrically communicate with a USB or USB-C, an Apple Lightning®, electromagnetic transmitter (e.g., smart phone, magnetic charger, Apple MagSafe® or other electromagnetism transmitter) or any other suitable interface. In some embodiments, the port 256 is accessible on the sole structure 208, such as on the midsole 212, along a sidewall 384. In some embodiments, the port 256 is accessible at the sidewall 384 on the medial side 118, the lateral side 116 (see FIG. 2), the toe end 140, or the heel end 146 of the footwear 300. In the illustrated embodiment, the port 256 is provided on the midsole 212 in the midfoot region 110 of the footwear 300.

In some embodiments, the power source 240 may be a storage cell, such as, e.g., a battery or a capacitor. In some embodiments, the power source 240 is a rechargeable storage cell that can receive and store electrical power delivered by the at least one port 256 disposed on or within the sole structure 208. In some embodiments, the power source 240 may be rechargeable wirelessly, without the use of any port 256, by proximity to a wireless charging pad or mat. The power source 240 may be a Nickel-Cadmium (NiCd), Nickel-Metal Hydride (NiMH), Lithium Ion (Li-ion), lead acid, or the like. In some embodiments, the power source 240 includes a plurality of storage cells and/or piezoelectric devices. In some embodiments, the power source 240 is removably received by the sole structure 208 of the footwear 300, such that the power source 240 may be removed, e.g., through an opening (not shown) in the sole structure 208 or the upper 204.

Still referring to FIG. 6, the control module 344 is provided to control the display device 328. For example, the control module 344 may be configured to send signals in the form of electrical power that can be measured as current changes and/or voltage changes to the conductive leads 260 within the second display system 324. The control module 344 is a switch or a switch matrix that can selectively intervene between the power source 240 and the display device 328. In some embodiments, the control module 344 is configured for binary operation, such that the at least one panel 232 of the display device 328 may either receive electrical power or may not receive power from the power source 240.

During operation, the at least one panel 232 begins at an initial or first state. In some embodiments, when a sufficient amount of electrical power is received by the at least one panel 232, the at least one panel 232 reaches an activated or second state. A sufficient amount of electrical power is defined as the amount of electrical power that is required to activate the at least one panel 232 to reach the second state. In some embodiments, the control module 344 is capable of modulation, such that the at least one panel 232 may receive a full amount of power, a minimum amount of power, and one or more intermediate levels of power therebetween from the power source 240. In some embodiments, the control module 344 is configured to selectively control or signal one or less than all of the at least one panels 232 of the display device 328. Therefore, one of the at least one panels 232 of the display device 328 may receive power while the other of the at least one panels 232 of the display device 328 may not receive power. As a result, each of the at least one panels 232 can reach the second state independently from another at least one panel 232. To that end, the control module 344 may be a central processing unit (CPU), or a printed circuit board (PCB) or a flexible circuit board, or the like. In some embodiments, more than one control modules 344 are provided for selective control of the display device 328 or portions of the display device 328.

With reference to FIG. 6, the control module 344 may receive inputs from the control system 336 via an or an at least one input device 396. The input device 396 may be any suitable type of sensor or actuator for communicating with the control module 344 to selectively control the display device 328. In some embodiments, the input device 396 is an at least one sensor 400. In some embodiments, the sensor 400 is a touch-activated sensor along which a user's finger can slide or tap to control the display device 328. Touch-activated sensors of various types are contemplated, including a capacitive touch slide sensor, a capacitive touch tap sensor, a resistive touch slide sensor, or a resistive touch tap sensor. In some embodiments, the at least one sensor 400 may be a vibration sensor that is configured to detect vibration frequencies caused by kinetic motion of the footwear 300 or applied to the footwear 300. Vibration sensors of various types are contemplated, including strain gauges, accelerometers, gyroscopes, or the like.

In some embodiments, the input device 396 is a microphone, such that sound waves of various frequencies may be detected for signaling the control module 344 of the display device 328. For example, the input device 396 may be capable of voice-activation by which the user can dictate "on" or "off" for controlling the display device 328. In some embodiments, the input device 396 is not provided on the footwear 300 and, instead, the user device 294 serves as the input device, which can be a user's smartphone, tablet, laptop, smartwatch or wearable electronic, special-purpose computer or device, or the like. For example, the user may access a mobile application via a smartphone for communication over a wireless communication network with the control module 344. In such embodiments, the control module 344 includes a wireless transceiver operating over a Wi-Fi connection, a Bluetooth® connection, an RFID or NFC connection, or the like. The user may control the display device 328 on the footwear 300 wirelessly via the mobile application on the smartphone. It will be appreciated that the user device 294 may be used to communicate with or control any of the embodiments described herein.

In the illustrated embodiment of FIG. 6, the at least one sensor 400 includes a first, forward or toe sensor 404 and a second, rear or heel sensor 408. In some embodiments, the forward sensor 404 is disposed on or retained within the toe end 140, the forefoot region 108, or the midfoot region 110 of the sole structure 208 such as the midsole 212. In some embodiments, the rear sensor 408 is disposed on or retained within the heel end 146, the heel region 112, or the midfoot region 110 of the sole structure 208 such as the midsole 212. In some embodiments, the forward sensor 404, the rear sensor 408, or both are piezoelectric type sensors. Piezoelectric sensors convert mechanical strain or movement into a voltage as the piezoelectric sensor is bent or distorted, which can be transmitted as a signal to the control module 344 to provide feedback. When the piezoelectric sensor experiences an acceleration, or a force, or a compression, feedback can be sent to the control module 344 as an electric signal.

In some embodiments, the forward sensor 404 and the rear sensor 408 are disposed on or retained within the sole structure 208 such that as a wearer of the footwear 300 takes a footstep, an electric signal can be generated by each of the forward sensor 404 and the rear sensor 408 depending on the particular phase of the footstep. For example, when the wearer of the footwear 300 takes a stride and first makes contact with the ground with the heel region 112 of the footwear 300, the rear sensor 408 may be activated to send a signal to the control module 344. For example, when the wearer of the footwear 300 takes a stride and last makes contact with the ground with the forefoot region 108 of the footwear 300, the forward sensor 404 may be activated to send a signal to the control module 344. In some embodiments, the forward sensor 404, the rear sensor 408, or both are a part of a rocker plate, e.g., a switch that toggles between two positions which can activate or not activate the piezoelectric sensor to send a signal to the control module 344. In some embodiments, the forward sensor 404, the rear sensor 408, or both are disposed on or retained within the plate 220. When the plate 220 is under strain or distorts, the piezoelectric sensor feature of the forward sensor 404, the rear sensor 408, or both can generate a voltage and send a signal to the control module 344.

Still referring to FIG. 6, the control module 344 may receive a signal from the input device 396, and the control module 344 may send a signal to the display device 328 through the forward connector 360. The signal can be measured as an increase in the voltage or as an increase in the current in the conductive lead 260 that is connected to the forward connector 360. The control module 344 may be able to distinguish the source of the signals to create an algorithm that outputs another signal to the forward connector 360 or another of the at least one connector 356. The display device 328, which includes the at least one panel 232, may be provided as part of the upper 204 in various configurations. In some embodiments, the at least one panel 232 may be provided as a discrete panel, layer, or segment that is applied to a portion of the upper 204. In some embodiments, the at least one panel 232 is permanently attached to the upper 204 by, e.g., adhesive, fastening, welding, knitting or weaving, molding, or the like. In some embodiments, the panel 232 is removably attached to the upper 204 by, e.g., fasteners, magnetic elements, adhesive, or the like.

The at least one panels 232 of the display device 328 may include an optoelectronic display technology, such as, e.g., electrophoretic ink. That is, the panel 232 may incorporate electronic paper technologies, including flexible electronic paper technologies, that provide an optoelectronic display while maintaining the comfort, durability, and lightweight properties of the upper 204. In some embodiments, each of the at least one connector 356 is electrically connected to the control module 344 by dedicated conductive leads 260, and each of the at least one connector 356 is electrically connected to one of the at least one panels 232 of the display device 328. The control module 344 is electrically connected to the forward connector 360 by one dedicated conductive lead 260. In turn, the forward connector 360 is electrically connected to a forward panel 412 that is a part of the display device 328. As noted above, the at least one connector 356 may be provided in the form of a thin film transistor (TFT) 364, which may be composed of a rigid material for stability or may be composed of a flexible material for resilience. Further, the TFT 364 may be provided along or across the display device 328 as part of the upper 204 or along the sole structure 208. In some embodiments, the TFT 364 may be composed of transparent or translucent materials to enable visibility of the display device 328.

In a preferred embodiment, the panels 232 of the display device 328 are passively operated, in that the panels 232 only draw power when changing a visual characteristic, e.g., color, and no power is drawn to sustain the visual characteristic on the display device 328. In some embodiments, when a signal is delivered to the forward panel 412, the signal activates the forward panel 412 to change from the first state, which may be a first color, to the second state, which may be a second color, the second color different than the first color. The forward panel 412 will exhibit the second color, even after the signal ceases. If a second signal is then delivered to the forward panel 412, the second signal may activate the forward panel 412 to change from the second state back to the first state, thereby changing the color from the second color back to the first color. The forward panel 412 will exhibit the first color, even after the second signal ceases. In this way, the control module 344 can convert the signals from the input devices 396 into a readily apparent visual change of one of the visual characteristics of the footwear 300, such as the color of at least one of the panels 232 of the upper 204. Moreover, since the color of the panel 232 is not dependent upon power being continuously maintained, the visual appearance of the upper 204 can be modified without a continuous consumption of energy.

In the illustrated embodiment of FIG. 6, the visual characteristic is a color, a luminous intensity, a resolution, a gloss, and the like. In some embodiments, the display device 328 is configured to display a static image, animation, text, symbols, logos, or the like. In some embodiments, the display device 328 is provided with a surface treatment, such as, e.g., an anti-glare treatment or coating, a moisture barrier, a scratch barrier or other protective coatings, and the like. The at least one panel 232 of the display device 328 may be disposed along the entire upper 204 from the toe end 140 to the heel end 146 and across the medial side 118 to the lateral side 116 (see FIG. 2). In some embodiments, the display device 328 is disposed within the forefoot region 108, the midfoot region 110, and the heel region 112 and along one of the medial side 118 or the lateral side 116. In some embodiments, the display device 328 is disposed within one of the forefoot region 108, the midfoot region 110, or the heel region 112. In some embodiments, the display device 328 is disposed within two of the forefoot region 108, the midfoot region 110, or the heel region 112. For example, the display device 328 may extend continuously from the forefoot region 108 to the midfoot region 110.

Figure 7A:
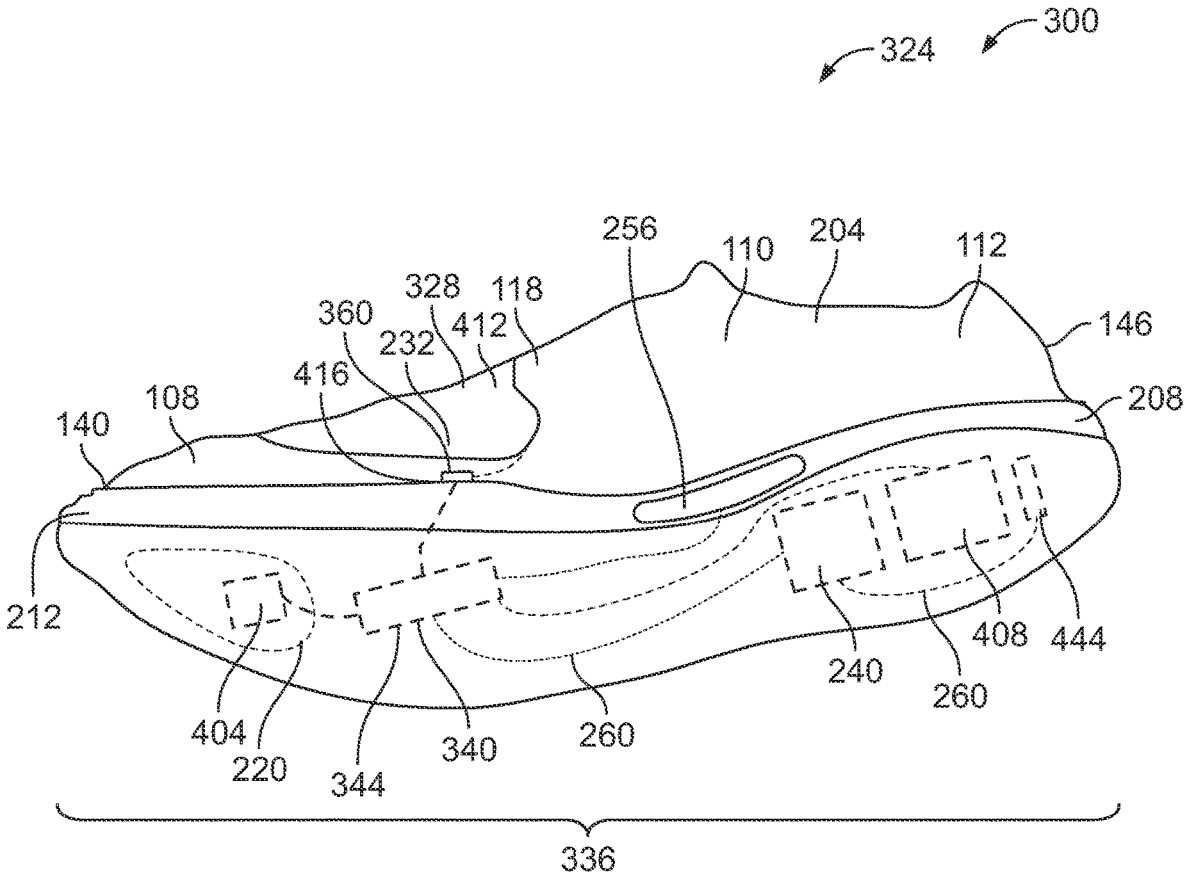
FIG. 7A is a schematic representation of a perspective view of a medial side of an article of footwear of FIG. 6 configured with a generator.

As illustrated in FIG. 7A, the second display system 324 has the display device 328 that includes the forward panel 412 that is attached to the upper 204, and the control system 336 is disposed on the midsole 212. The control system 336 includes the first circuit 340 which includes the control module 344 and the power source 240. The control system 336 is electrically connected to each of the port 256, the power source 240, the forward sensor 404, the rear sensor 408, and the forward connector 360 by conductive leads 260. In some embodiments, the forward connector 360 and/or the display device 328 includes a first TFT 416 in combination with the power source 240, as represented schematically in FIG. 7A. In the illustrated embodiment, the forward connector 360 is positioned on the periphery 368 of the upper 204 on the medial side 118 of the footwear 300.

In the illustrated embodiment of FIG. 7A, the power source 240 of the first circuit 340 is a rechargeable storage cell that can receive and store electrical power delivered by the at least one port 256 or from a generator 444 that is part of the control system 336. The generator 444 is disposed on or within the sole structure 208 such as the midsole 212. In some embodiments, the generator 444 includes an energy harvesting device, such as a piezoelectric device that is configured to convert kinetic energy into electrical energy for powering or controlling the second display system 324. When present, the generator or generators 444 are electrically connected to the power source 240 by the conductive lead 260. In all other respects, the illustrated footwear 300 of FIG. 6 is similar to the illustrated footwear 300 of FIG. 7A.

Figure 7B:
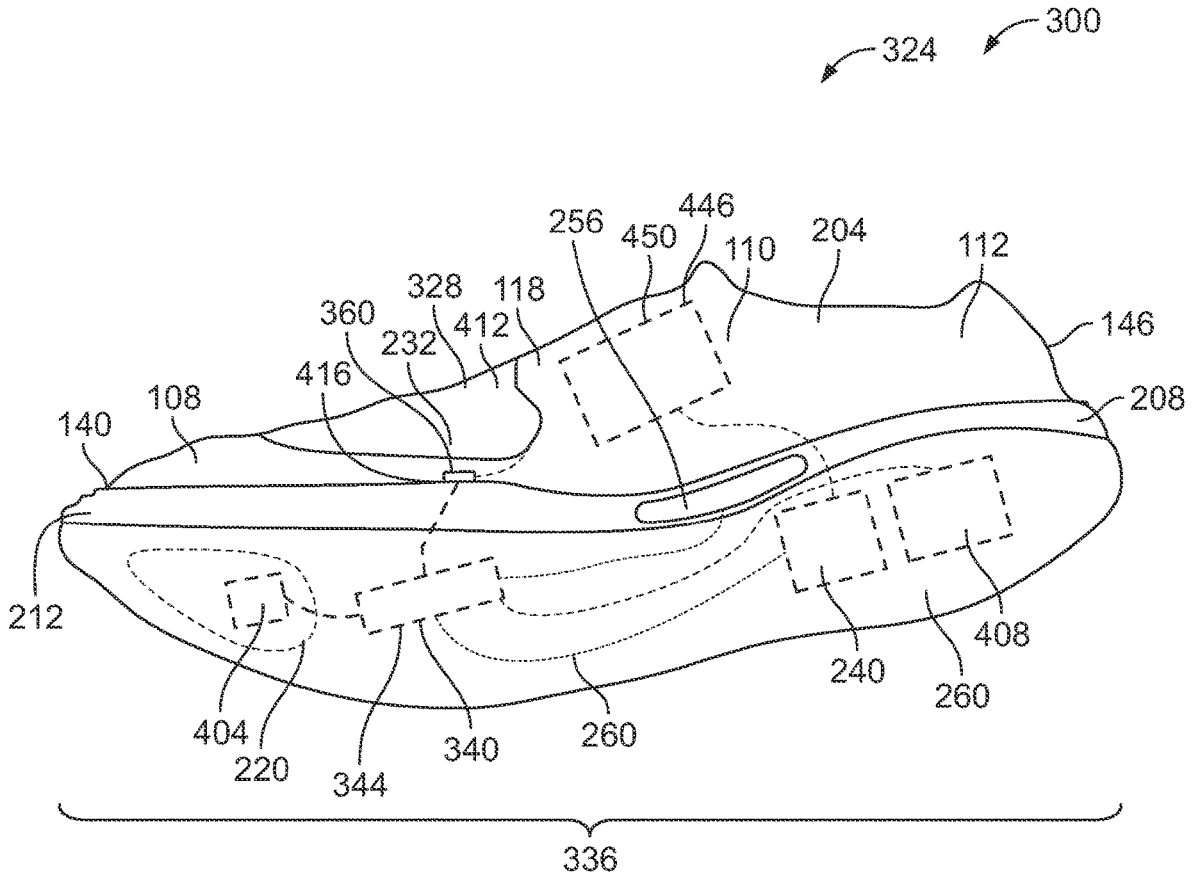
FIG. 7B is a schematic representation of a perspective view of a medial side of FIG. 6 configured with solar cells.

Referring to the illustrated embodiment of FIG. 7B, the power source 240 of the first circuit 340 is a rechargeable storage cell that can receive and store electrical power delivered by the at least one port 256 or from a generator 446 that is part of the control system 336. In some embodiments, the generator 446 includes an energy harvesting device such as one or more solar cells 450 that are configured to convert solar energy into electrical energy for powering or controlling the second display system 324. For example, the solar cells 450 may include one or more solar panels mounted onto an external surface of the upper 102, instep region 168, or tongue 170. As another example, the solar cells 450 may include solar power fabrics or textiles (e.g., photovoltaics, HeliaFilm®, SolarCloth, ASCA®, SolviusArc®) that may make up a part of the textile forming the upper 102, instep region 168, or tongue 170. The solar cells 450 may be electrically connected to the power source 240 by conductive leads 260. In other respects, the illustrated footwear 300 of FIG. 7B is similar to the illustrated footwear 300 of FIG. 6.

Figure 7C:
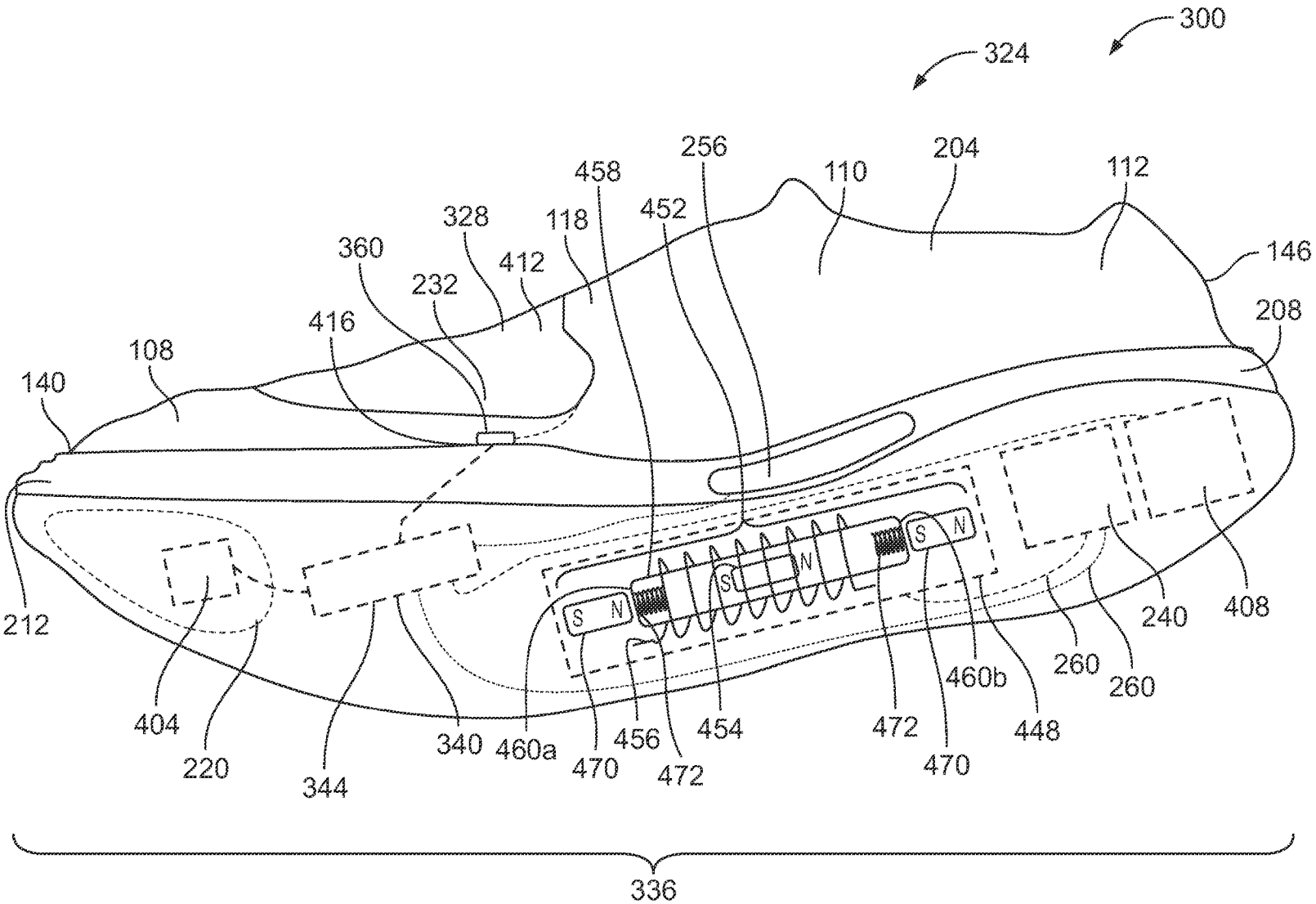
FIG. 7C is a schematic representation of a perspective view of a medial side of FIG. 6 configured with an electromagnetism system according to an embodiment of the disclosure.

Referring now to the illustrated embodiment of FIG. 7C, the power source 240 of the first circuit 340 is a rechargeable storage cell that can receive and store electrical power delivered by the at least one port 256 or from a generator 448 that is part of the control system 336. In some embodiments, the generator 446 includes an energy harvesting device, such as one or more electromagnetism systems 452 configured to generate electrical current based on Faraday's law of induction. The electromagnetism system 452 may be positioned within the sole structure 104, as shown. The electromagnetism system 452 may also be positioned within or fixed onto the upper 102. For example, the electromagnetism system 452 may be integrated with a logo or other design mounted on an external surface of the upper.

Each electromagnetism system 452 includes one or more permanent magnet elements 454 inside a channel 458 and a conductive coil 456 that is wrapped at least partly around the channel 458. The magnet element 454 is configured to slide back and forth within the channel 458 between the two ends 460*a* and 460*b* of the channel. The magnet element 454 creates a magnetic field which moves through the conductive coil 456 as the magnet element 454 slides through the channel 458. This moving magnetic field induces a current in the conductive coil 456.

In some embodiments, the magnet element 454 is configured to slide through the channel 458 based on the force of gravity or a force applied by the user. For example, as the use walks, runs, or shakes the article of footwear 300, the magnet element 454 will slide back and forth in the channel 458 to generate a current. The conductive coil 456 can be electrically connected to the power source 240 by a circuit containing conductive leads 260. The circuit connection between the conductive coil 456 and the power source 240 may further include one or more diodes. For example, a diode may be used to prevent the storage cell 264 from discharging back to the power source 240. A diode may also be used to protect the circuit from high voltage surges or to convert the current from alternating current (AC) to direct current (DC) in order to charge the storage cell 264. In this way, the electromagnetic system 452 can provide electrical power to the power source 240 as the user walks, runs, or shakes the article of footwear 300 and the magnet element 454 slides through the conductive coil 456 in one or both directions.

The electromagnetism system 452 may further include two optional permanent magnet elements 470 located in or outside of the ends 460*a* and 460*b* of the channel 458 to repel the magnet element 454 in the channel 458. This may prevent the magnet element 454 from contacting the ends 460*a* and 460*b* of the channel 458 to reduce noise during use and/or bias the magnet element 454 in a certain direction or position. The electromagnetism system 452 may also optionally include bumpers or springs 472 on one or both ends 460*a* and 460*b* of the channel 458, which may be configured to reduce noise as the magnet element 454 contacts the ends 460*a* and 460*b* of the channel 458 and/or bias the magnet back in the opposite direction or position.

Figure 7D:
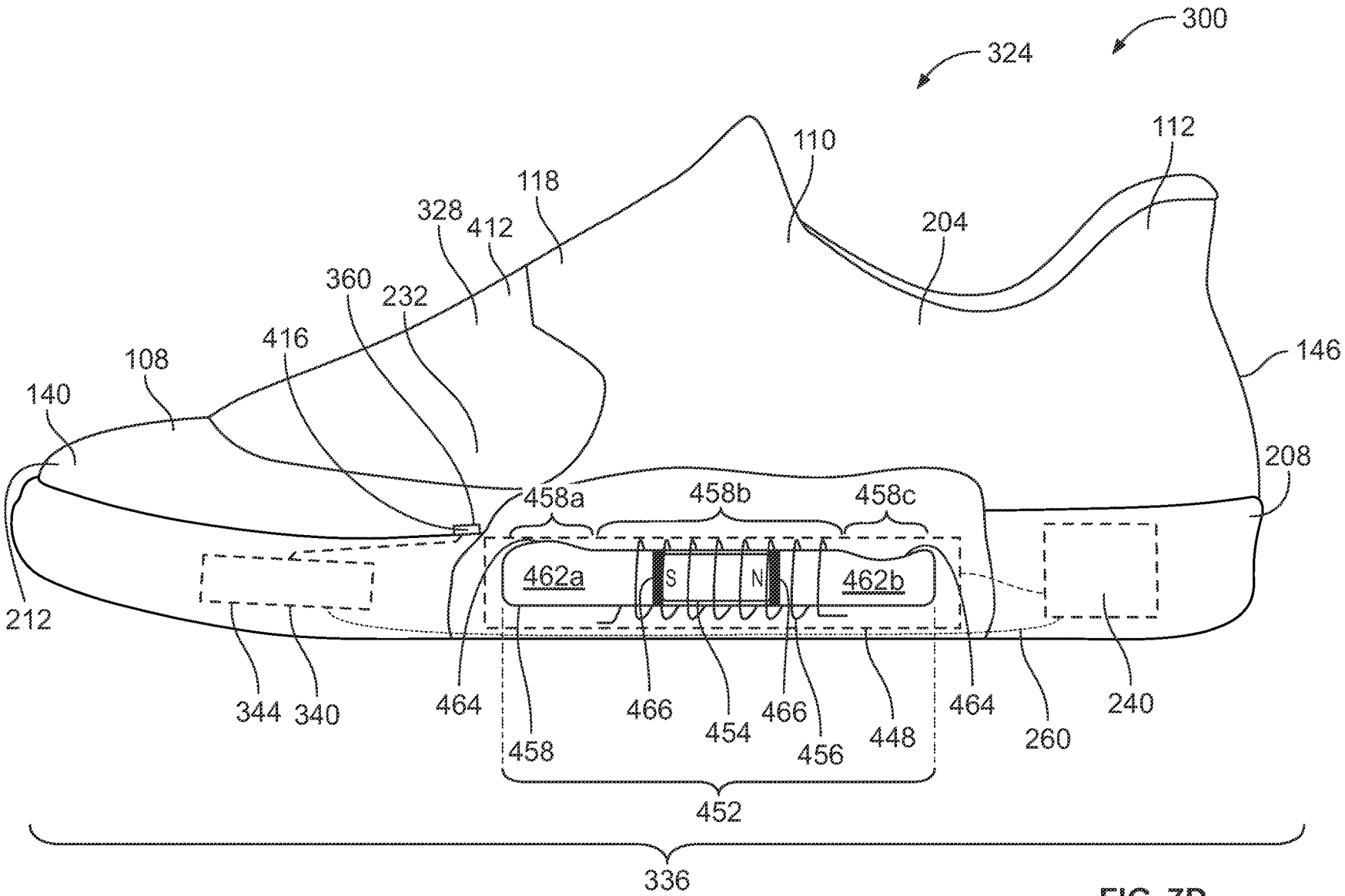
FIG. 7D is a schematic representation of a cut-away side view of the article of footwear of FIG. 6 illustrating an example electromagnetism component of the article of footwear of FIG. 6 according to another embodiment of the disclosure, not drawn to scale.
Figure 7E:
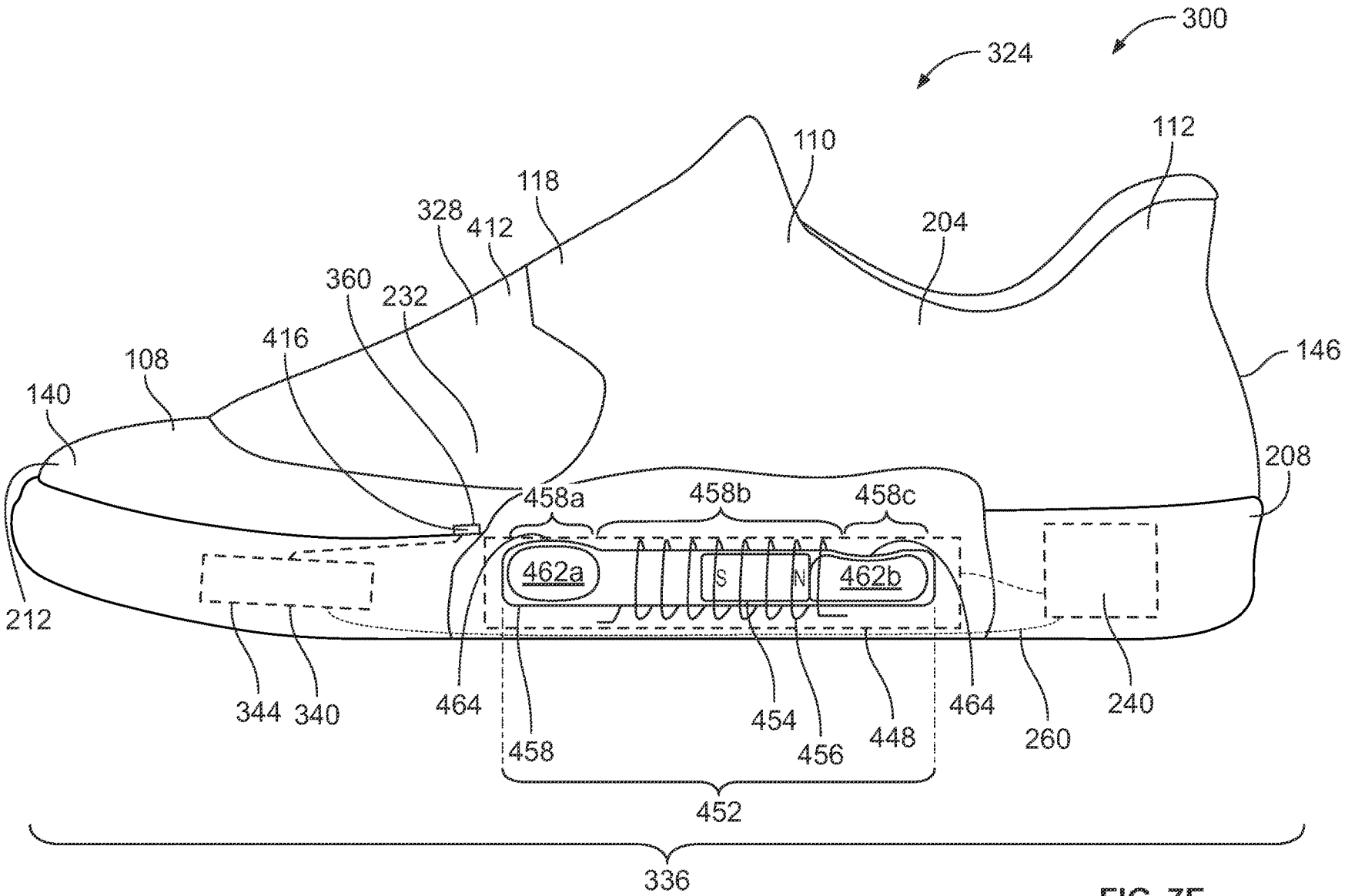
FIG. 7E is a schematic representation of a cut-away side view of the article of footwear of FIG. 6 illustrating another example electromagnetism system according to another embodiment of the disclosure, not drawn to scale.

In other embodiments, as illustrated in FIGS. 7D-7E, the magnet element 454 is configured to slide through the channel 458 based on a force applied by a user. The channel 458 may be defined by three sections 458*a*, 458*b*, and 458*c*, in which the magnet element 454 slides within section 458*b* and sections 458*a* and 458*c* are located on either side of the section 458*b*. A wall 464 of the channel in section 458*a* and 458*c* may be deformable in response to pressure applied by a user, such by a user's foot during use. The channel 458 may contain two sealed chambers 462*a* and 462*b*, located in sections 458*a* and 458*c*, that are filled with a gas or fluid. For example, the chambers 462*a* and 462*b* may be formed by a sealing structure 466, such as a seal, that is coupled to the magnet element 454, as shown in FIG. 7D. In some embodiments, the channel 458 is provided in the form of a sealed deformable structure with the wall 464 being capable of flexure, e.g., compression or expansion, in some areas and prevented from flexure in other areas to control the deformation during use. In this way, a downward force applied to the deformable wall 464 of the chamber 458 in section 458*c* (e.g., by the heel of the user's foot) causes an increase in pressure in chamber 462*b*. This increase in pressure can provide a force to the sealing structure 466, and thereby the magnet element 454 to move towards section 458*a*. Similarly, a downward force applied in section 458*a* (e.g., by the ball of a user's foot) can cause the magnet element 454 to move through the chamber 458 and coil 456 towards section 458*c*. In this way, the magnet element 454 can slide back and forth within the chamber 458, and thereby through the conductive coil 456 to generate a current in the conductive coil 456.

In some embodiments, the sealed chambers 462*a* and 462*b* are provided in the form of balloons or other deformable chambers located within the channel 458 in sections 458*a* and 458*c*, as shown in FIG. 7E. The balloons or chambers 462*a* and 462*b* can apply a force onto the magnet element 454 to cause the magnet element to slide through the channel 458. For example, when a downward force is applied to the wall 464 in section 458*c* (e.g., by the heel of the user's foot), the chamber 462*b* will expand and/or deform to push the magnet element 454 through the channel towards section 458*a*. Similarly, when a downward force is applied in section 458*a* (e.g., by the ball of the user's foot), chamber 462*a* will expand and/or deform to push the magnet element 454 towards section 458*c*. In this way, the magnet element 454 can be caused to move back and forth through the chamber 458 and conductive coil 456 throughout various stages of a user's stride or gate. Thus, as a user walks or runs, for example, a current is generated in the conductive coil 456.

Figure 8:
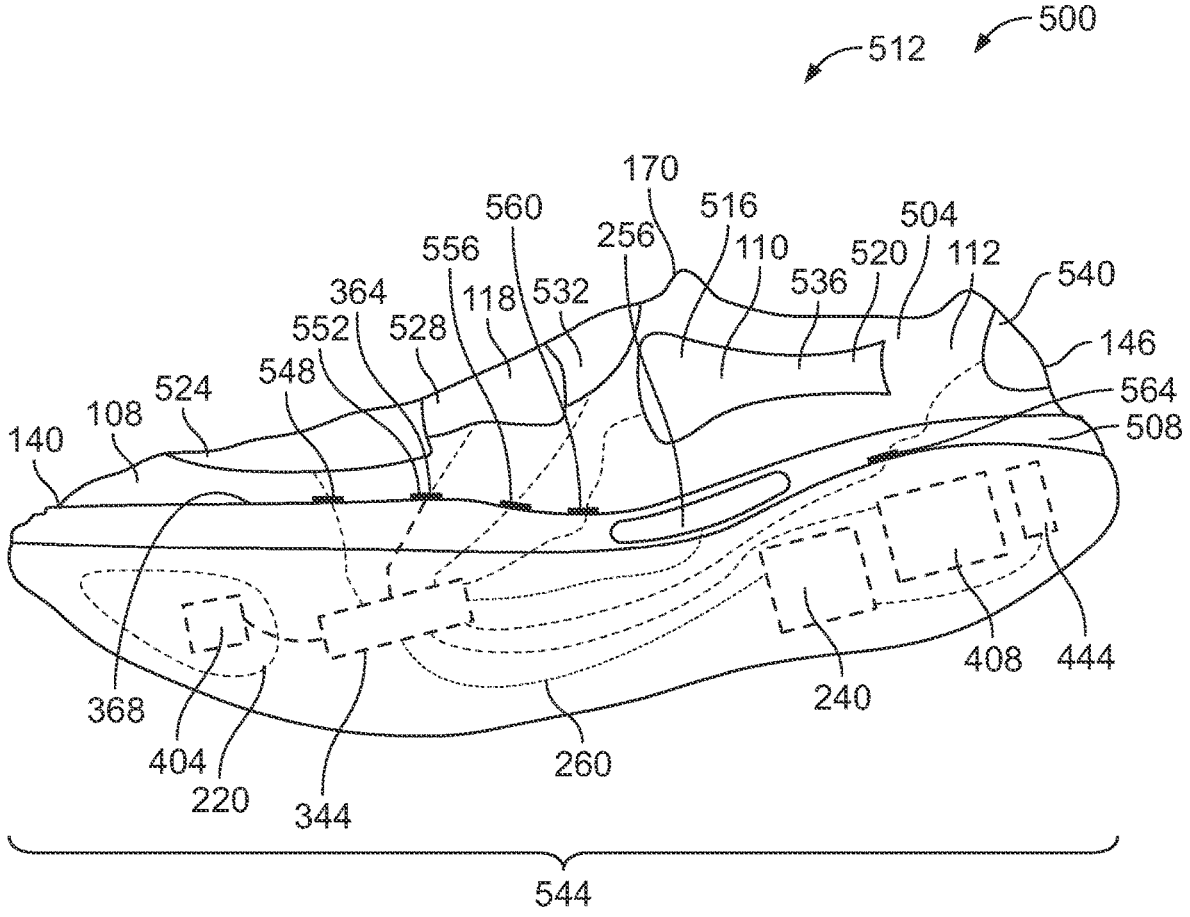
FIG. 8 is a schematic representation of an elevational view of a medial side of an article of footwear with a display system, configured as a right shoe, according to still another embodiment of the disclosure.

With reference to FIG. 8, another embodiment of an article of footwear 500 includes an upper 504 that is attached to a sole structure 508, and a third display system 512. The third display system 512 has a display device 516 with at least one panel 520 that includes a first panel 524, a second panel 528, a third panel 532, a fourth panel 536, and a fifth panel 540. The first panel 524 and the second panel 528 are disposed on the upper 504 within the forefoot region 108 of the footwear 500. The third panel 532 and the fourth panel 536 are disposed on the upper 504 within the midfoot region 110, and the fifth panel 540 is disposed on the upper 504 with the heel region 112 of the footwear 500. Further, the footwear 500 includes a second circuit 544 comprising the power source 240, the control module 344, and the conductive leads 260 extending therebetween. It will be appreciated that the power source 240 of the second circuit 544 may be similar to the power source 240 of the footwear 300 of FIGS. 6 and 7. In this embodiment, elements that are shared with, i.e., that are structurally and/or functionally identical to, elements present in the first embodiment of the footwear 100 are represented by equivalent reference numerals. Further, the control module 344 of the second circuit 544 may be similar to the control module 344 of the footwear 300 of FIGS. 6 and 7. The illustrated embodiment of FIG. 8 includes the generator 444 which may be similar to the generator 444 of FIG. 7A, and the port 256, the forward sensor 404, and the rear sensor 408 which may be similar to the port 256, the forward sensor 404, and the rear sensor 408 of FIGS. 6 and 7.

The illustrated embodiment of FIG. 8 has the first panel 524 electrically connected to a first contact 548, the second panel 528 electrically connected to a second contact 552, the third panel 532 electrically connected to a third contact 556, the fourth panel 536 electrically connected to a fourth contact 560, and the fifth panel 540 electrically connected to a fifth contact 564. The first, second, third, fourth, and fifth contacts 548, 552, 556, 560, 564 are each disposed along the periphery 368. Each of the first, second, third, fourth, and fifth contacts 548, 552, 556, 560, 564 can include the TFT 364 which regulates a threshold voltage that will permit the signal to transmit to the respective first, second, third, fourth, or fifth panels 524, 528, 532, 536, 540. Each of the first, second, third, fourth, and fifth contacts 548, 552, 556, 560, 564 is electrically connected to the respective first, second, third, fourth, or fifth panels 524, 528, 532, 536, 540 and the control module 344 by their respective conductive leads 260.

Although the illustrated embodiment of FIG. 8 depicts five panels 524, 528, 532, 536, 540 and portions of the upper 504 that are not a part of the display device 516, it is contemplated that in other embodiments that the entire surface of the upper could be covered by panels 520, or that the panels 520 could be selected to cover various surface areas that are different than what is depicted in FIG. 8. In some embodiments, all of the panels 520 may cover the upper 504 in only the forefoot region 108 or may only be covering the medial side 118 or the lateral side 116 (see FIG. 2) of the footwear 500. In some embodiments, all of the panels 520 may cover the midfoot region 110 or the heel region 112. In some embodiments, the panels 520 may be arranged on or adjacent to the tongue 170 or along or adjacent to the periphery 368 of the upper 504.

Since each of the first, second, third, fourth, or fifth panels 524, 528, 532, 536, 540 have the ability to display two different colors when in the second state and the first state, and each of the first, second, third, fourth, or fifth panels 524, 528, 532, 536, 540 are connected to the control module 344 by their own path, a wide array of different displays can be generated. In one embodiment, the first panel 524 exhibits the first state and associated color, and the third panel 532 exhibits the second state and associated color. In one embodiment, the control module 344 could be programmed to transmit a signal to the first, third, and fifth panels 524, 532, 540 when the forward sensor 404 is activated, and to transmit a signal to the second panel 528 and the fourth panel 536 when the rear sensor 408 is activated. In some embodiments, the control module 344 could be programmed to transmit a signal to each of the first, second, third, fourth, or fifth panels 524, 528, 532, 536, 540 in a timed delay with respect to one another. For example, the first panel 524 could get a signal from the control module 344 four seconds before the fifth panel 540, three seconds before the fourth panel 536, two seconds before the third panel 532, and one second before the second panel 528. This would create a visual effect of movement, even if the footwear 500 was immobile. In some embodiments, the control module 344 could receive input from the port 256 and select to signal the first panel 524 and the fifth panel 540 in order to display a color scheme that was consistent with a team that was "home" or "away". In some embodiments, the control module 344 could send signals in random patterns or arrays to the various panels 524, 528, 532, 536, 540 to present a visual display that keeps changing over time.

Figure 9:
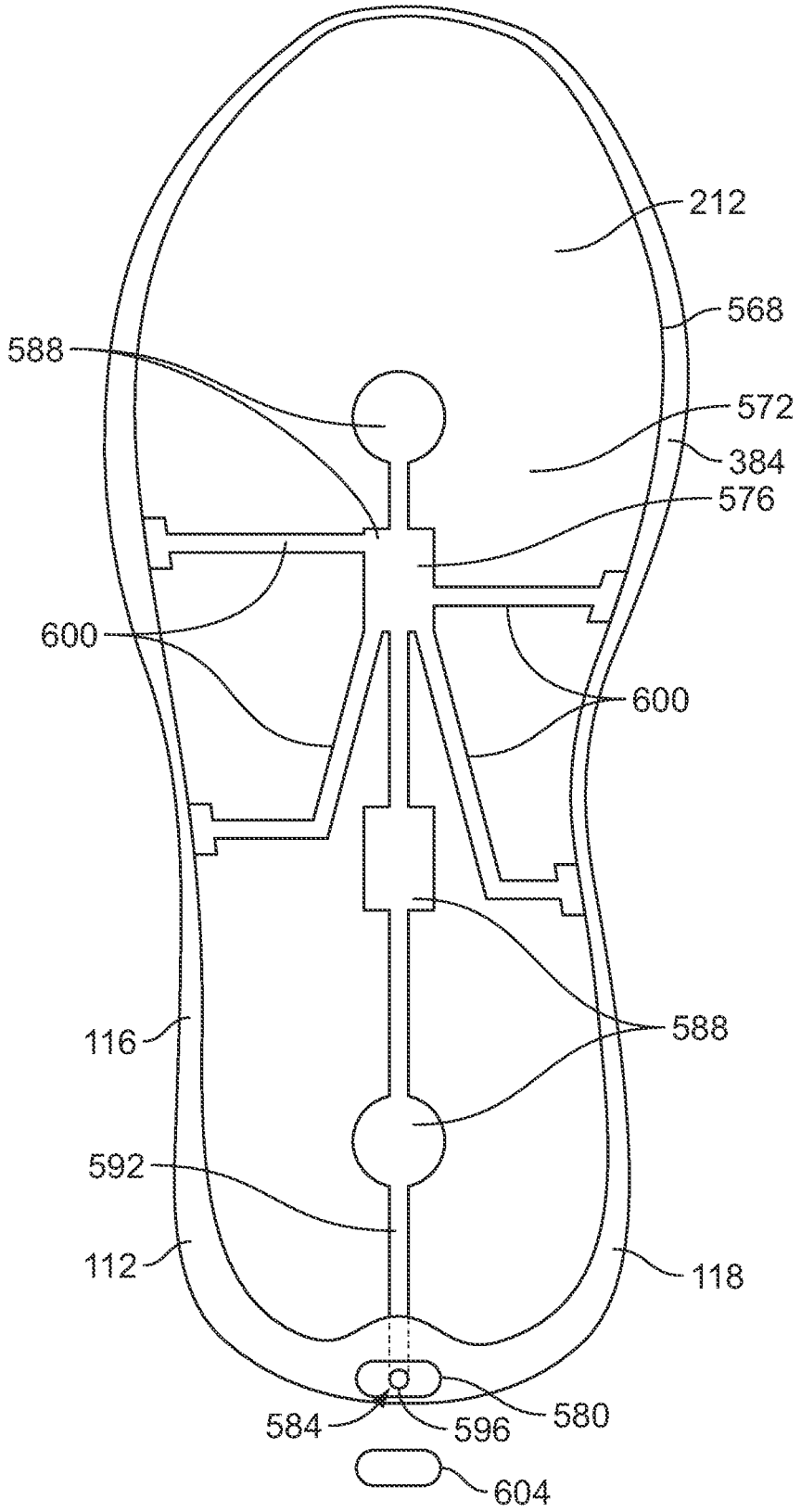
FIG. 9 is a schematic representation of a top plan view of a midsole with a cutout section suitable for use with a control module.

In the illustrated embodiment of FIG. 9, the midsole 212 has an edge 568 positioned between the sidewall 384 and a top surface 572 with a cutout section 576 that is either molded into the top surface 572 of the midsole 212 or is a volume of material removed from the midsole 212 along the top surface 572. In some embodiments, the cutout section 576 also includes a rear aperture 580 that defines a rear cavity 584 located in the heel region 112 along the sidewall 384. The cutout section 576 is configured to receive the control system 336 (see FIG. 6) in a plurality of recesses 588 which are sized and configured to receive the forward sensor 404 (see FIG. 6 for 404, 408, 344, and 248), the rear sensor 408, the control module 344, and the power source 240. The cutout section 576 further comprises a rear channel 592 that connects to the plurality of recesses 588 and a rear recess 596 that is configured to receive the port 256 (see FIG. 6), and a plurality of channels 600 that project toward the medial side 118 and the lateral side 116 of the midsole 212. In the illustrated embodiment of FIG. 9, the rear recess 596 and at least a portion of the rear channel 592 are embedded in the midsole 212. In some embodiments, the rear recess 596 is a portion of the sidewall 384 in the heel region 112.

In some embodiments, after the control system 336 of the third display system 512 (see FIG. 8) is received in the cutout section 576, the insole 126 (see FIG. 2) is positioned over the top surface 572 to cover the control system 336. In some embodiments, a cap 604 is configured to selectively cover the rear recess 596 to serve as a dust cover for the port 256. In the illustrated embodiment of FIG. 9, the cutout section 576 locates the port 256 in the rear recess 596 in the heel region 112 and can accommodate up to two conductive leads 260 on the medial side 118 and up to two conductive leads 260 on the lateral side 116. The cutout section 576 illustrated in FIG. 9 provides a way to dispose and embed the control system 336 on and in the midsole 212.

Figure 10:
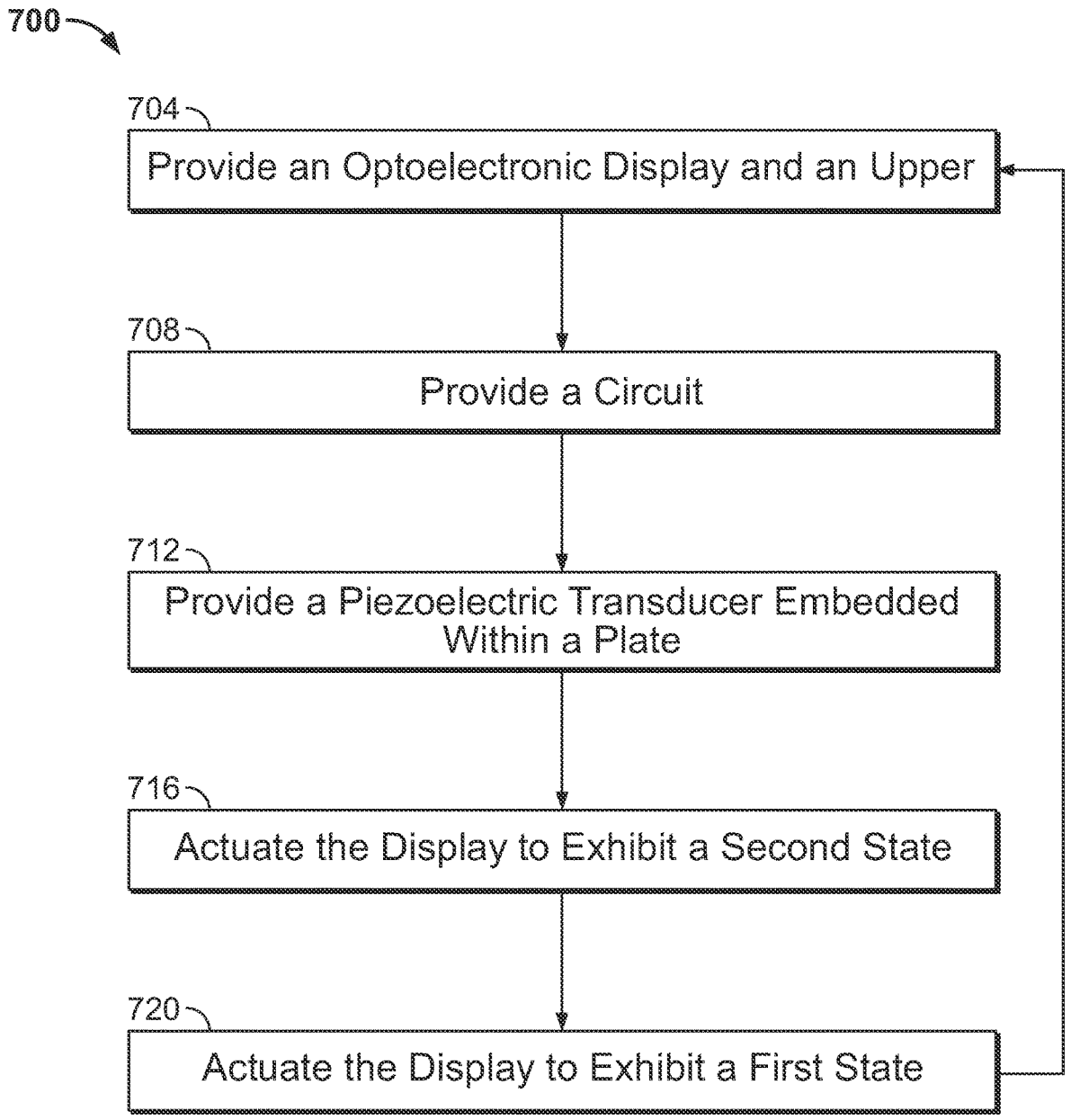
FIG. 10 is a diagram that illustrates the flow of a signal having a current from a power source to the electrophoretic layer.

In the illustrated embodiment of FIG. 10, a system of one or more computers, such as the processor 248 (see FIG. 5A), can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by a data processing apparatus, cause the apparatus to perform the actions. FIG. 10 illustrates an exemplary method 700 of using a display, such as the display device 328 (see FIG. 6), for an article of footwear, such as the article of footwear 500 of FIG. 8. The method 700 includes a step 704 of providing an optoelectronic display, such as the display device 328 including one or more panels 232 (see FIG. 6) exhibiting a first state with a first color, on the upper 204 of the article of footwear 500. In some embodiments, the optoelectronic display device 328 is provided in the form of a plurality of fibers that include the electrophoretic material and the electrodes (not shown). The plurality of fibers may be woven, knitted, or otherwise intertwined to form the display 328 and connected with electrical contacts, such as, e.g., the electrical connector 356, to enable power and control of the display 328. In some embodiments, the optoelectronic display 328 is provided on the sole structure 208.

In a step 708, the method 700 further includes providing a circuit, such as the first circuit 340 (see FIG. 6), within the sole structure 208 attached to the upper 204, where the circuit 340 includes the power source 240, the control module 344, and conductive leads 260. In a step 712, the method 700 includes providing one or more piezoelectric transducers 268 that are embedded within a plate, such as the plate 220 (see FIG. 4), disposed in the sole structure 208. In a step 716, the method 700 includes actuating the optoelectronic display 328 (see FIG. 6) to switch, exhibit, or display from the first state to the second state having a second color by applying the threshold voltage as a signal to one or more of the panels 232 of the optoelectronic display 328. In a step 720, the method 700 includes actuating the optoelectronic display 328 to switch, exhibit, or display from the second state to the first state having a first color by applying the threshold voltage as a signal to one or more of the panels 232 of the optoelectronic display 328. The method 700 can be repeated to transition the optoelectronic display 328 between the first state and the second state by repeating the steps 704, 708, 712, 716, 720 of the method 700. In this way, the optoelectronic display 328 can change the color and thereby the display on the article of footwear 300 as desired or as programmed. Other embodiments of this aspect include corresponding computer systems, apparatuses, and computer programs recorded on one or more computer storage devices, each configured to perform the actions of the methods.

Implementations may include one or more of the following features. The method where the optoelectronic display may include electrophoretic ink. The plurality of piezoelectric transducers may include a first transducer, a second transducer, and a third transducer, where second transducer is positioned between the first transducer and the third transducer. The first transducer is located in the forefoot region and disposed along a lateral side of the plate, and the third transducer is located in the forefoot region and disposed along the medial side of the plate. The plate may include carbon fiber. The storage cell includes a capacitor that is operatively connected to the plurality of piezoelectric transducers. The control module is operatively connected to the plurality of piezoelectric transducers. Implementations of the described techniques may include hardware, a method or process, or computer software on a computer-accessible medium.

In other embodiments, other configurations are possible. For example, certain features and combinations of features that are presented with respect to particular embodiments in the discussion above can be utilized in other embodiments and in other combinations, as appropriate. Further, any of the embodiments described herein may be modified to include any of the structures or methodologies disclosed in connection with other embodiments. Additionally, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the invention has been described above in connection with particular embodiments and examples, the invention is not necessarily so limited, and that numerous other embodiments, examples, uses, modifications, and departures from the embodiments, examples, and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

We claim:

1. An article of footwear, comprising:

an upper attached to a sole structure along a periphery, wherein the sole structure includes a midsole and an outsole;

a display device that includes an optoelectronic display;

a control module that is embedded within a plate of the article of footwear, the control module being configured to communicate with the display device; and a power source that is embedded within the plate, wherein the plate is positioned adjacent to the midsole, wherein the plate includes conductive leads embedded within a substrate, and wherein the conductive leads are electrically connected to a connector on the periphery of the upper.

2. The article of footwear of claim 1, wherein the power source includes a piezoelectric transducer.

3. The article of footwear of claim 2, wherein the power source includes a storage cell that is electrically connected to the piezoelectric transducer.

4. The article of footwear of claim 3, wherein the storage cell is provided within a heel region of the plate.

5. The article of footwear of claim 1, wherein the power source is selectively electrically connected to the display device.

6. The article of footwear of claim 1, wherein the power source is selectively electrically connected to the display device by a switch.

7. The article of footwear of claim 1, wherein the optoelectronic display comprises electrophoretic ink.

8. The article of footwear of claim 1, wherein the display device is located in a portion of the upper of the article of footwear.

9. The article of footwear of claim 1, wherein the display device comprises a plurality of panels configured to change color when a sufficient electrical charge is applied.

10. The article of footwear of claim 1, wherein the control module is further configured to receive input from a user.

11. A method of manufacturing an article of footwear having an optoelectronic display configured to display a first color in a first portion of an upper and a second color in a second portion of the upper, wherein the second portion is different from the first portion and the first color is different from the second color, the method comprising:

providing an optoelectronic display on an upper of an article of footwear;

providing a circuit in a plate within a sole structure, wherein the circuit includes a storage cell, a control module, and conductive leads, and wherein a plurality of piezoelectric transducers are embedded within the plate disposed in the sole structure; and attaching the upper to the sole structure along a periphery, wherein the conductive leads are electrically connected to a connector on the periphery.

12. The method of claim 11, wherein the optoelectronic display comprises electrophoretic ink.

13. The method of claim 11, wherein the plurality of piezoelectric transducers comprises a first transducer, a second transducer, and a third transducer, wherein the second transducer is positioned between the first transducer and the third transducer.

14. The method of claim 13, wherein the first transducer is located in a forefoot region and disposed along a lateral side of the plate, and wherein the third transducer is located in the forefoot region and disposed along a medial side of the plate.

15. The method of claim 11, wherein the plate comprises carbon fiber.

16. The method of claim 11, wherein the storage cell includes a capacitor that is operatively connected to the plurality of piezoelectric transducers.

17. The method of claim 11, wherein the control module is operatively connected to the plurality of piezoelectric transducers.

* * * * *